US005842081A

United States Patent [19]

Kaname et al.

[11] Patent Number: 5,842,081

[45] Date of Patent: Nov. 24, 1998

[54] METHOD AND APPARATUS FOR CHARGING AN ELECTROGRAPHIC PHOTORECEPTOR

[75] Inventors: Yoichi Kaname; Akio Arai; Ryuji Katsuno; Yasutomo Ishii; Yoshitaka Kuroda; Jin Iwasaki, all of Ebina, Japan

[73] Assignee: Fuji Xerox Co., Ltd., Tokyo, Japan

[21] Appl. No.: 654,144

[22] Filed: May 28, 1996

[30] Foreign Application Priority Data

| | | | |
|---|---|---|---|
| May 31, 1995 | [JP] | Japan | 7-133235 |
| Oct. 17, 1995 | [JP] | Japan | 7-268872 |
| Feb. 15, 1996 | [JP] | Japan | 8-028175 |
| Mar. 4, 1996 | [JP] | Japan | 8-045841 |

[51] Int. Cl.[6] ..... G03G 15/02

[52] U.S. Cl. ..... 399/50; 361/221; 361/225; 399/174; 399/176

[58] Field of Search ..... 399/50, 100, 174–176; 361/221, 225, 230

[56] References Cited

U.S. PATENT DOCUMENTS

| | | | |
|---|---|---|---|
| 4,371,252 | 2/1983 | Uchida et al. | 399/175 |
| 5,426,488 | 6/1995 | Hayakawa et al. | 399/174 |
| 5,446,615 | 8/1995 | Matsumoto et al. | 361/225 |
| 5,483,323 | 1/1996 | Matsuda et al. | 399/175 |
| 5,610,691 | 3/1997 | Takahashi et al. | 399/176 |

FOREIGN PATENT DOCUMENTS

| | | |
|---|---|---|
| 4-301861 | 10/1992 | Japan . |
| 6-95478 | 4/1994 | Japan . |

*Primary Examiner*—William J. Royer
*Attorney, Agent, or Firm*—Oliff & Berridge, PLC

[57] ABSTRACT

A charging method in which the surface of an image bearing device is charged in two steps in contact with the surface of the image bearing device before a latent image is formed on the surface of the image bearing device, the contact charging method includes two steps. First, the surface of the image bearing device is charged with a contact charging device which applies a voltage consisting of an AC component and a DC component superposed on the AC component. Second, the surface of the image bearing device is charged by a contact charging device applied with such a DC voltage as to discharge at least part of a pattern of charge potential variation of which the pitch corresponds to the frequency pitch of the AC component, which is caused in the primary charging operation.

20 Claims, 24 Drawing Sheets

| | | SOIL | PICTURE QUALITY |
|---|---|---|---|
| CASE 1 | FIRST CHARGING ROLL | G6 | ×× |
| | SECOND CHARGING ROLL | G6 | |
| CASE 2 | FIRST CHARGING BLADE | G2 | × |
| | SECOND CHARGING BLADE | G2 | |
| CASE 3 | FIRST CHARGING BLADE | G2 | ○ |
| | SECOND CHARGING ROLL | G2 | |

| | SOIL | PICTURE QUALITY |
|---|---|---|
| FIRST CHARGING BLADE | NONE | ◎ |
| SECOND CHARGING ROLL | G1 | |

METHOD AND APPARATUS FOR CHARGING AN ELECTROGRAPHIC PHOTORECEPTOR

BACKGROUND OF THE INVENTION

The present invention relates to a method of charging a photoreceptor in an electrophotographic printing type apparatus, and an image bearing means made of dielectric material, for example, in an electrostatic printing system, a charging device used in the charging method, and an image forming apparatus with the charging device.

A corona charging device has widely been used as a charging device for charging the image bearing means in an image forming apparatus, such as an electrophotographic copying machine, a laser printer, or an electrostatic printing machine. Recently, more attention has been paid to a contact charging device than to the corona charging device. In the contact charging device, a rotary roll, a brush, a blade or the like being applied with a charging voltage is brought into contact with an image bearing means, to thereby charge the surface of the image bearing means. In one of the contact charging devices, known and currently marketed, a single charging roll is used which rotates in contact with the image bearing means, and a voltage consisting of an AC voltage and a DC voltage superposed on the AC component is applied to the charging roll.

This type of the charging device, which uses the single charging roll applied with the voltage consisting of the AC and DC components, has some problems to be solved. In the charging operation, attraction and repulsion forces act between the charging roll and the image bearing means. These forces cause the image bearing means to vibrate. The vibration will generate noise. Discharging phenomenon, caused by the AC component, deteriorates the surface of the image bearing means. Further, a cleaning blade, for example, slides on the surface of the image bearing means to possibly abrade the surface thereof. For this reason, it is impossible to increase the current, which is fed to the charging roll under the voltage applied thereto, and to increase the frequency of the AC component of that voltage. In order to prevent the deterioration and the abrasion of the surface of the image bearing means, a measure to decrease the frequency of the AC component may be employed. However, if the frequency of the AC component is decreased, the charging of the surface of the photoreceptor is not uniform, and black stripes appear on the printed image. When the surface of the charging roll is worn, the film thickness is reduced. The charge start voltage of the charging roll and the charging potential per se vary when the ambient condition varies. This results in deterioration of the image quality, for example, variation of density and fog on the printed image.

To solve the problems of the contact charging device which uses the single charging roll applied with the voltage consisting of the AC and DC components, there are some proposals. In the first proposal, two contact chargers are sequentially arranged which charge the image bearing means in contact therewith. The width of a nip of the charger, particularly the second charger, to the image bearing means is larger than the pitch of a variation of the charge potential, which corresponds to the frequency pitch caused by the charging operation by the first charger, to thereby prevent generation of the charging sound and the charge potential variation (Published Unexamined Japanese Patent Application No. Hei. 4-301861). In the second proposal, two contact chargers are sequentially arranged which charge the image bearing means in contact therewith. In the proposal, a constant voltage is applied to the charger, particularly the second charger, whereby the charge potential variation caused by the first charger is suppressed (Published Unexamined Japanese Patent Application No. Hei. 6-95478).

The two contact charging devices described above have the following problems.

The first contact charging device neutralizes the charge potential variations on the surface of the image bearing means, to some extent. Accordingly, a less variation of the charge potential is left. However, the contact charging device merely moderates the charge potential variation, and cannot completely solve the charge potential variation. As a process speed of the image bearing means is high, the contact charging device can insufficiently reduce potential differences between the exposed portions and nonexposed portions on the surface of the image bearing means, which are formed in the preceding image forming cycle. In forming an image, particularly a half-tone image, density differences are vague on the printed image.

In the second contact charging device in which the constant voltage is applied to the second charger, a DC voltage, which is the same as the DC component applied to the first charger, is applied to the second charger. The charging operation of the second charger, applied with such a voltage, can insufficiently remove the charge potential variation caused by the first charger. A pattern of density variation, which results from a pattern of minutely varied potential distribution, appears on the resultant image. The charge potential variation caused by the first charger may be corrected (made gentle to some extent) by charge injection. This approach, however, unsatisfactorily removes the potential variation. The contact charging device has a limit (approximately 100 mm/s in process speed) in following up an increase of the practical process speed. In this respect, the contact charging device is not adaptable for high speed machines.

SUMMARY OF THE INVENTION

Accordingly, an object of the present invention is to provide a charging method, a charging device and an image forming apparatus, which can sufficiently reduce a charge potential variation, caused by the charging operation based on the voltage consisting of the AC and the DC components superposed on the AC component, can stabilize the charge potential irrespective of the variation of ambient conditions and the film thickness reduction of the image bearing means owing to its aging, and is adaptable for high speed machines.

A charging method of the present invention is a contact charging method in which the surface of an image bearing means is charged in two steps in contact with the surface of the image bearing means before a latent image is formed on the surface of the image bearing means, the contact charging method comprising the steps of: primarily charging the surface of the image bearing means by contact charging means applied with a voltage consisting of an AC component and a DC component superposed on the AC component; and secondarily charging the surface of the image bearing means by the contact charging means applied with such a DC voltage as to vary at least part of a pattern of charge potential variation of which the pitch corresponds to the frequency pitch of the AC component, caused in the primary charging operation, through a discharging operation to be caused by the DC voltage per se.

In the charging method, a single contact charging means may be used for both the primary and the secondary charging operations. Preferably, two different contact charging means are used for the primary charging operation and the secondary charging operation, respectively. The DC voltage to vary at least part of a pattern of charge potential variation, through a discharging operation to be caused by the DC voltage per se, is such a DC voltage which causes the difference between the peak potential in the charge potential variation and the charge potential by the secondary charging operation to be preferably 30 V or lower, more preferably 10 V or lower.

A charging device of the present invention is a contact charging device in which the surface of the image bearing means is charged in two steps before a latent image is formed on the image bearing means, the contact charging device comprising: a first contact charger for primarily charging the surface of the image bearing means in a state that the first contact charger receives a voltage consisting of an AC component and a DC component superposed on the AC component; and a second contact charger for secondarily charging the surface of the image bearing means in a state that the second contact charger receives such a DC voltage as to vary at least part of a pattern of charge potential variation of which the pitch corresponds to the frequency pitch of the AC component, caused in the primary charging operation, through a discharging operation to be caused by the DC voltage per se.

An image forming apparatus of the present invention having an image bearing means, first and second chargers, sequentially arranged, for charging the image bearing means in a state that the first and the second chargers are in contact with the image bearing means, and first and second voltage applying means for applying voltages to the first and the second chargers, characterized in that the first voltage applying means applies a voltage consisting of an AC component and a DC component superposed on the AC component to the first charger, and the second voltage applying means applies to the second charger such a DC voltage as to vary at least part of a pattern of charge potential variation of which the pitch corresponds to the frequency pitch of the AC component, caused in the primary charging operation, through a discharging operation to be caused by the DC voltage per se.

In the charging method, the charging device and the image forming apparatus, which are thus constructed, the DC voltage applied to the contact charging means for secondarily charging the surface of the image bearing means is preferably such a DC voltage as to entirely vary a pattern of charge potential variation of which the pitch corresponds to the frequency pitch of the AC component, caused in the primary charging operation, through a discharging operation to be caused by the DC voltage per se.

In the charging method, the charging device and the image forming apparatus, the DC voltage to be applied to the contact charging means for secondarily charging the surface of the image bearing means is preferably controlled such that a current flowing into the contact charging means is detected and it has a constant value.

In the charging method, the charging device and the image forming apparatus, any type of charger may be used for the first and the second chargers, but a contact charger of the blade, brush or film type is preferable for the first charger, and a contact charger of the roll type is preferable for the second charger.

In the present invention, the image bearing means may be a photoreceptor or made of dielectric material. The image transferring roll, the cleaning blade or the like, in lieu of a normal charger, may be used for the contact charging means for carrying out the primary charging operation.

The technical means described above varies at least a part of a pattern of charge potential variation, of which the pitch corresponds to the frequency pitch of the AC component, caused in the primary charging operation, (so as to be corrected to a desired charge potential) through the secondary discharging operation. Accordingly, the charge potential variation is reliably and remarkably reduced.

In the technique disclosed in Published Unexamined Japanese Patent Application No. Hei. 6-95478, the same potential as the DC component for the first charger is merely applied to the second charger. Actually, the charge injection by the second charger suppresses the charge potential variation to some extent. However, a discharging phenomenon, which in the present invention, takes place upon the application of a discharge start voltage according to Paschen's law, does not take place in the disclosed technique. Therefore, the charge potential variation caused by the primary charging operation is still left. In the conventional charging operation based on the charge injection by the second charger, a minute variation of the surface resistance or the volume resistance of the charging means brings about a pattern of varied charge potential, and it appears as a pattern of varied density in the resultant image.

In the present invention, such a DC voltage as to entirely vary a pattern of charge potential variation of which the pitch corresponds to the frequency pitch of the AC component, caused in the primary charging operation, through a discharging operation to be caused by the DC voltage per se, is applied to the contact charging means for the secondary charging operation. Therefore, the charge potential variation in the primary charging operation is completely removed. If an actual charge potential of the image bearing means drops below (becomes lower than) a target value as the result of the variation of ambient conditions and the film thickness reduction of the image bearing means owing to its aging, the top or the bottom of a variation of the AC component exceeds above the charge potential. Therefore, an average value of the charge potential values of the image bearing means is correspondingly close to the target potential value, so that the charge potential on the image bearing means is stabilized.

The DC voltage, which is applied to the contact charging means for secondarily charging the surface of the image bearing means, is controlled such that a current flowing into the contact charging means is detected, and it has a constant value.

DETAILED DESCRIPTION OF THE PREFERRED EMBODIMENTS

The preferred embodiment of the present invention will be described with reference to the accompanying drawings.

Figure 1:
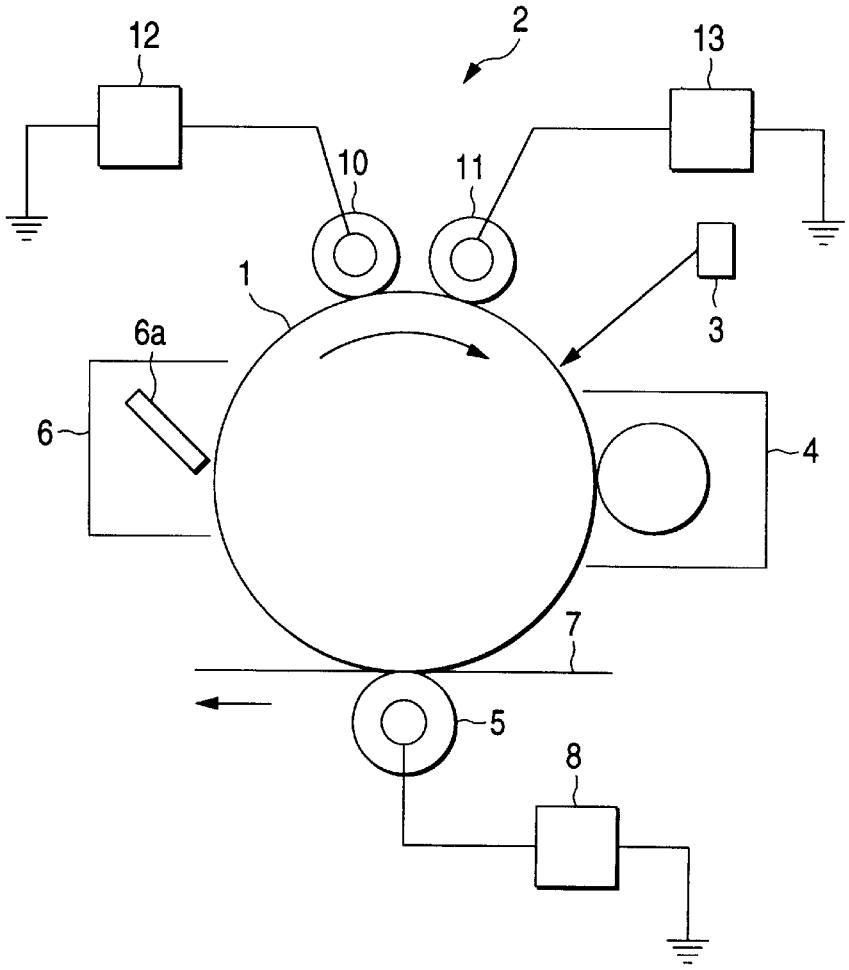
FIG. 1 is a diagram showing an embodiment of an image forming apparatus into which the present invention is incorporated.

FIG. 1 is a diagram showing an embodiment of an image forming apparatus into which the present invention is incorporated. As shown, the image forming apparatus includes a photoreceptor 1, which takes the form of a drum and serves as an image bearing means rotating in the direction of an arrow. A charger unit 2, an exposure unit 3, a developing unit 4, an image transfer roll 5, and a cleaning unit 6 are disposed around the photoreceptor 1 in this order. In the figure, reference numeral 7 designates a recording paper, and numeral 8 designates a power source for applying a given voltage to the transfer roll 5.

Figure 2:
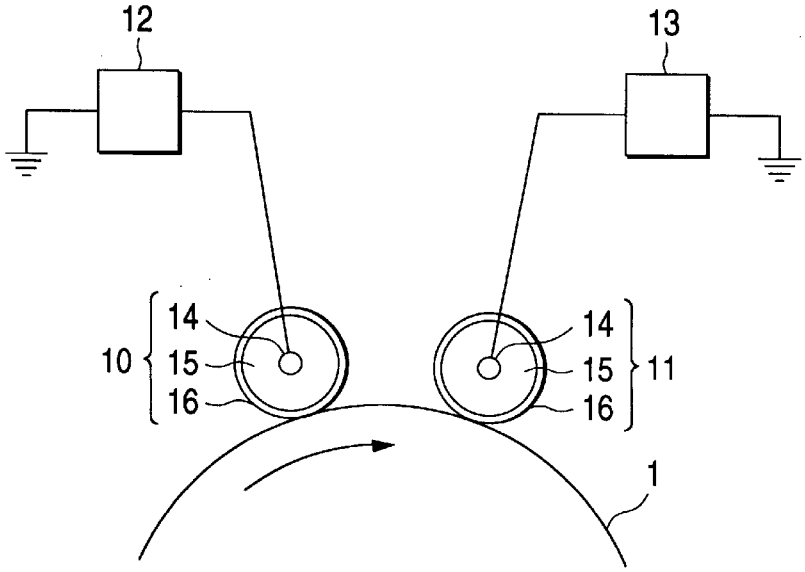
FIG. 2 is a diagram showing a charging device applied to the image forming apparatus of FIG. 1.

The charger 2, as shown in FIGS. 1 and 2, is made up of a first charging roll 10 rotatably disposed upstream of the photoreceptor 1 when viewed in the rotation direction of the photoreceptor, a second charging roll 11 rotatably disposed upstream of the photoreceptor 1, a first-charger power source 12 for applying a voltage consisting of a DC component and an AC component superposed on the DC component to the first charging roll 10, and a second-charger power source 13 for applying a given DC voltage to the second charging roll 11.

The first and the second charging rolls 10 and 11, as shown in FIG. 2, are each formed of a conductive support shaft 14 made of iron, copper, stainless, aluminum or the like, and a rubber layer 15 and a surface layer 16, which are formed on the conductive support shaft 14. The rubber layer 15 is made of EPDM rubber containing conductive material, for example, carbon black, disposed therein, polyurethane rubber containing ion conductifying agent, for example, $LiClO_4$, dispersed therein, or the like. The surface layer 16 is formed to have a volume resistance of $10^{-5}$ to $10^{9}$, and made of synthetic resin, such as polyamide, polyurethane, polyethylene, and acryl, which contains conductive particles, for example, carbon black or aluminum, dispersed therein, polyurethane rubber containing ion conductifying agent, for example, $LiClO_4$, dispersed therein, or the like. The thickness of the surface layer 16 may be within a range from 1 to 50 $\mu$m. A pressure resistive layer may be formed between the rubber layer 15 and the surface layer 16 in order to prevent the leakage by pinholes. The pressure resistive layer may be formed, 10 to 50 $\mu$m thick, in a manner that SnOx coated with $BaSO_4$ is added to cyan resin or pyran resin.

In the image forming apparatus of the present embodiment, the surface of the rotating photoreceptor 1 is successively charged in two steps up to given charge potentials by the two charging rolls 10 and 11. The charging operation in the first step is referred to as a primary charging operation, and the charging operation in the second step is referred to as a secondary charging operation. The charged surface of the photoreceptor is exposed to light containing image information in the exposure unit 3, so that an electrostatic latent image is formed. The photoreceptor 1 bearing the latent image formed thereon is moved to the developing unit 4 where the latent image is developed to form a toner image thereon. The toner image is transferred onto the recording paper 7 when it passes between the photoreceptor 1 and the transfer roll 5. Following the image transferring process, toner left on the photoreceptor 1 is removed by a cleaning blade 6*a* of the cleaning unit 6, and the photoreceptor stands ready for the next image forming process.

Figure 3:
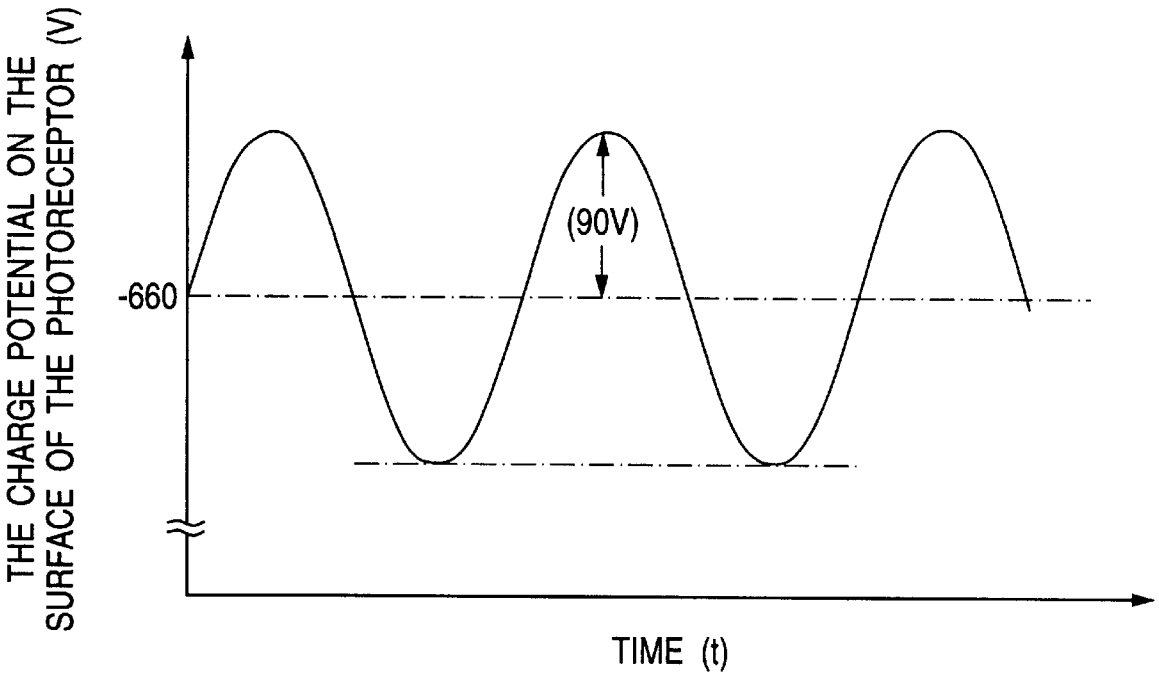
FIG. 3 is a graph showing a variation of the charge potential on the surface of the photoreceptor immediately after it passes the first charging roll.
Figure 4:
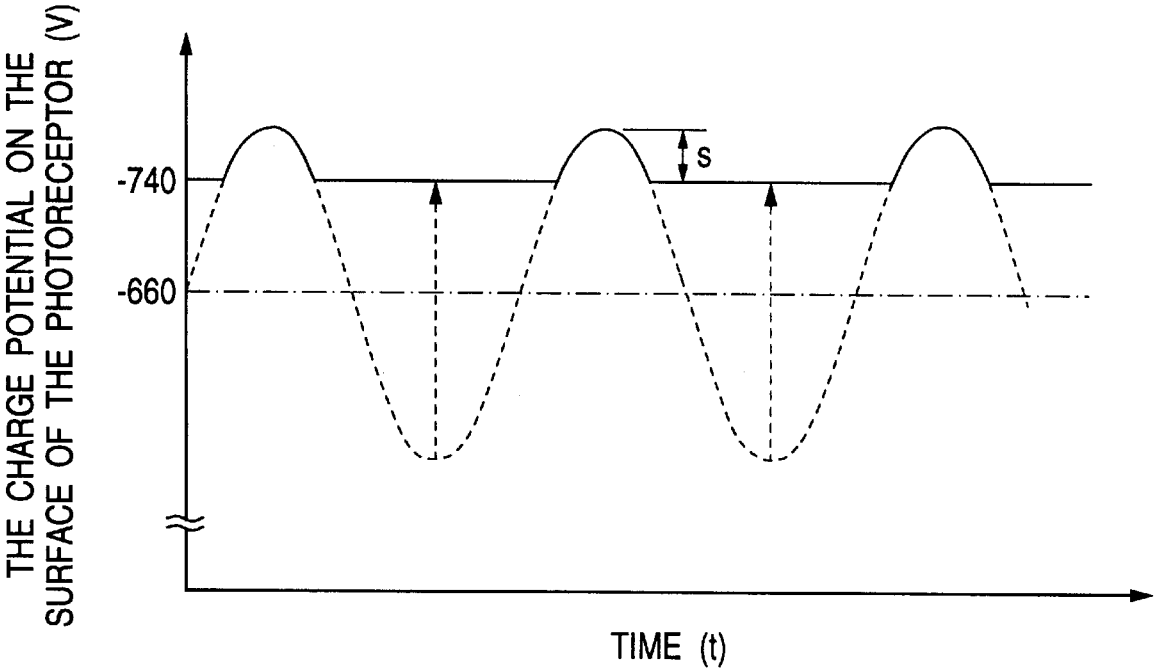
FIG. 4 is a graph showing a variation of the charge potential on the surface of the photoreceptor immediately after it passes the second charging roll.

The following tests were conducted to examine the charging performances by the charger unit 2. A rotating speed of the photoreceptor 1 was 300 mm/s. A voltage, which consists of a DC component of 660 V and an AC component of 1500 Vp-p and at 500 Hz superposed onto the DC component, was applied to the first charging roll 10. A DC voltage of −1340 V was applied to the second charging roll 11. The photoreceptor 1 was charged by the charger unit 2. Then, a charge potential on the photoreceptor 1 was measured. The discharge start voltage (at normal temperature and under normal pressure) was −600 V. The results of the measurement are shown in FIGS. 3 and 4. The graph of FIG. 3 shows a variation of the charge potential on the surface of the photoreceptor immediately after it passes the first charging roll 10. The graph of FIG. 4 shows a variation of the charge potential on the surface of the photoreceptor immediately after it passes the second charging roll 11.

As shown in FIGS. 3 and 4, a part (indicated by a dotted line in FIG. 4) of a pattern of the charge potential variation, of which the pitch (indicated by a solid line in FIG. 3) corresponds to the frequency pitch of the AC component, caused in the primary charging operation by the first charging roll 10, is varied up to a potential beyond the discharge start voltage, through the secondary discharging operation by the second charging roll 11. As a result, the charge potential is varied as indicated by a solid line in FIG. 4. A contour line representative of the variation of the resultant charge potential shows that the charge potential variation is remarkably suppressed. In this embodiment, a potential difference between a peak value of the charge potential caused by the primary charging operation and the charge potential caused by the secondary charging operation is 10 V or lower. During the charging operation, an unpleasant noise was not generated. Further, an image, which was formed by the image forming process containing the thus conditioned charging operations, was free from density differences, black stripes and the like. Additionally, even at a high process speed of 300 mm/s, the charging operation was smooth.

Another test was conducted. In the test, the surface of the photoreceptor 1 was charged under the same conditions as those of the first test except that a DC voltage (−1380 V in this instance) was applied to the second charging roll 11 in the charger unit 2, the DC voltage causing the surface of the photoreceptor to be discharged such that a pattern of the charge potential variation, of which the pitch corresponds to the frequency pitch of the AC component, caused in the primary charging operation by the first charging roll 10, is entirely varied to a potential beyond the discharge start voltage. The results of the test are shown in FIG. 5.

Figure 5:
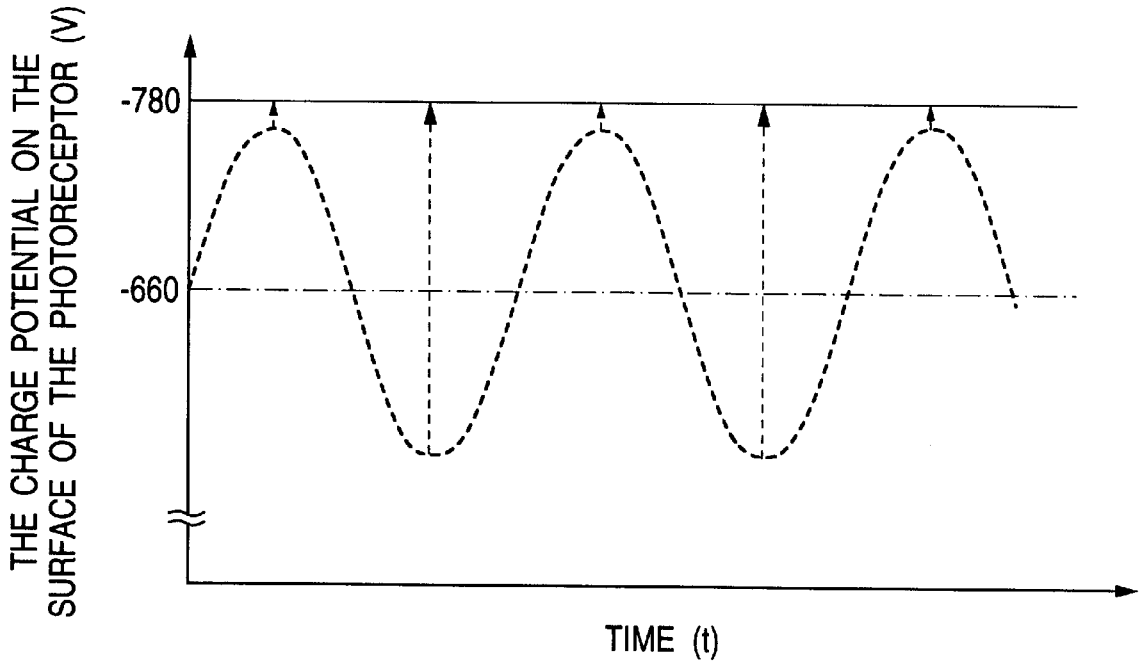
FIG. 5 is a graph showing a state of the charge potential on the surface of the photoreceptor immediately after it passes the second charging roll when the whole pattern of the discharge potential variation is varied to the negative polarity through the discharge.

As shown in FIG. 5, the whole pattern of the charge potential variation, of which the pitch corresponds to the frequency pitch of the AC component, caused in the primary charging operation by the first charging roll 10, is varied up to a potential beyond the discharge start voltage, through the secondary charging operation by the second charging roll 11. The resultant charge potential is invariable at a fixed potential (−780 V) as indicated by a solid line in the figure. This shows that the charge potential variation caused by the primary charging operation is completely removed. During the charging operation, an unpleasant noise was not generated. Further, an image, which was formed by the image forming process containing the thus conditioned charging operations, was free from density differences, black stripes and the like.

Figure 6:
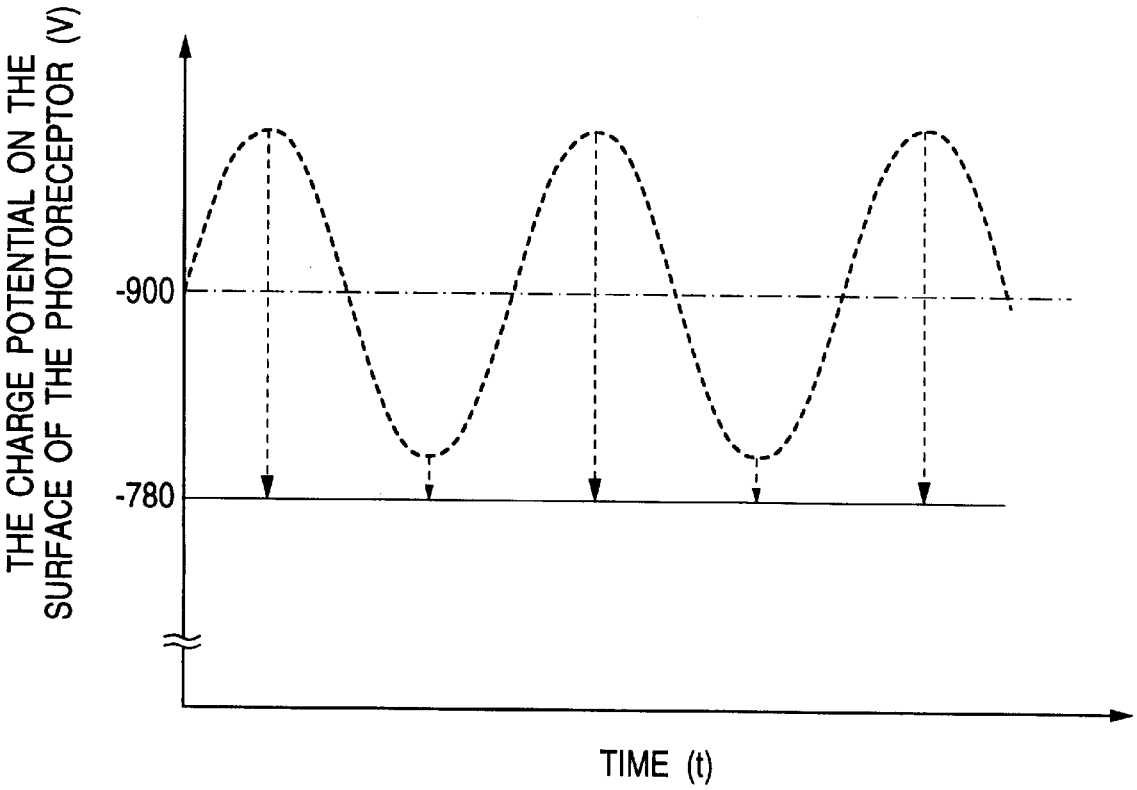
FIG. 6 is a graph showing a state of the charge potential on the surface of the photoreceptor immediately after it passes the second charging roll when the whole pattern of the discharge potential variation is varied to the positive polarity through the discharge.

A variation of the charge potential on the surface of the photoreceptor was examined when a DC voltage (−180 V) was applied to the second charging roll 11 in the charger unit 2 of the present embodiment. When the DC voltage, which causes the surface of the photoreceptor to be discharged such that a pattern of the charge potential variation, of which the pitch corresponds to the frequency pitch of the AC component, caused in the primary charging operation by the first charging roll 10, is entirely varied to a potential beyond the discharge start voltage, is applied to the second charging roll 11 of the charger unit 2, the photoreceptor surface is discharged to the same polarity (negative polarity) as of the primary charge potential in the above-mentioned case (FIG. 5), but it is discharged to the polarity opposite to that of the primary charge potential in this case. The voltage consisting of a DC component of −900 V and an AC component of 1500 Vp-p and at 500 Hz superposed on the DC component was applied to the first charging roll 10. The discharge start voltage (at normal temperature and under normal pressure) was +600 V. The results of the test are shown in FIG. 6.

Even in the case where the DC voltage, which causes the photoreceptor surface to be discharged to the polarity opposite to that of the primary charge potential, is applied to the second charging roll 11, the pattern (indicated by a dotted line) of the charge potential variation, of which the pitch corresponds to the frequency pitch of the AC component, caused in the primary charging operation by the first charging roll 10, is varied into a fixed potential (−780 V). Accordingly, the variation of the charge potential caused by the primary charging operation is completely removed. Also in this case, an unpleasant noise was not generated during the charging operation. Further, an image, which was formed by the image forming process containing the thus conditioned charging operations, was free from density differences, black stripes and the like.

When a DC voltage, the DC voltage causing the surface of the photoreceptor to be discharged such that the whole pattern of the charge potential variation, of which the pitch corresponds to the frequency pitch of the AC component, caused in the primary charging operation by the first charging roll 10, is varied to a potential beyond the discharge start voltage, is applied to the second charging roll 11 in the charger unit 2, the charge potential on the photoreceptor is stabilized even if the ambient conditions (temperature and humidity) vary, as in the two cases described above.

Figure 7:
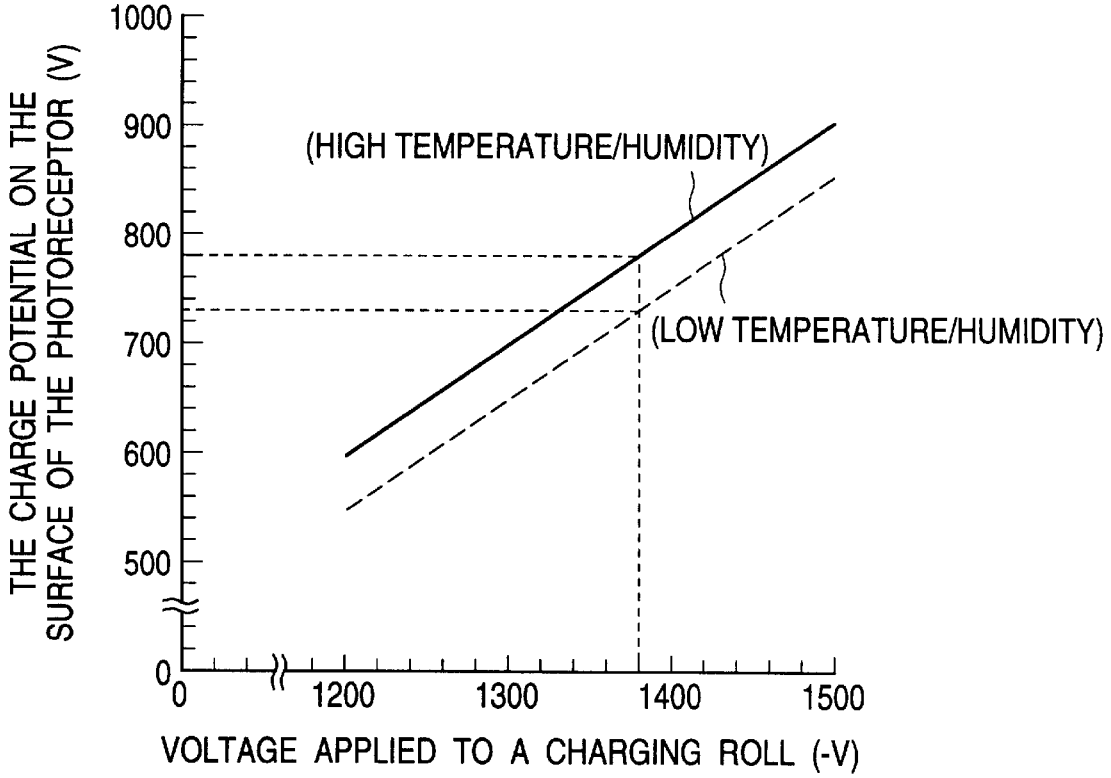
FIG. 7 is a graph showing variations of the charge potential of the photoreceptor surface at different ambient conditions when the charging is performed by using one charging roll applied with a DC voltage.
Figure 8:
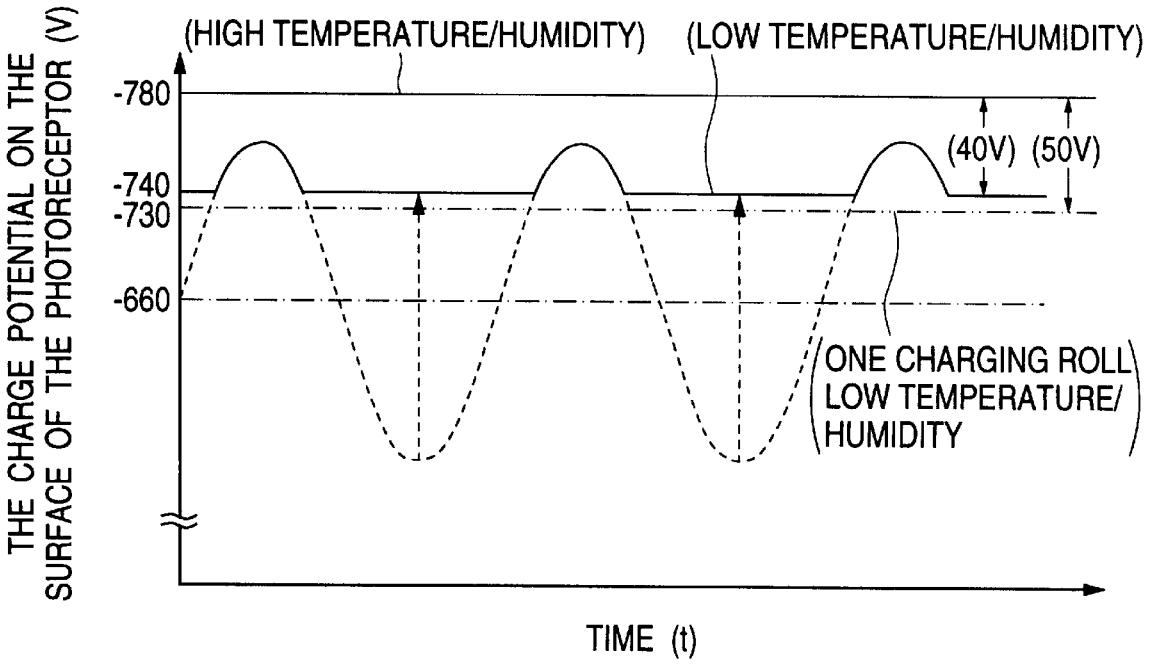
FIG. 8 is a graph showing variations of the charge potential of the photoreceptor surface at different ambient conditions when the charging is performed by using the charging device of the present invention.

In the charging device which uses only one charging roll applied with the DC voltage for charging the photoreceptor 1 (also a case of the charge by the second charging roll 11), the discharge start voltage when the device is in the charging mode changes with the change of the ambient condition. Accordingly the charge potential of the surface of the photoreceptor also varies, as shown in FIG. 7. In the charging operation under the same voltage (−1300 V) applied, when the ambient condition is changed, the charge potential greatly changes. For example, approximately 50 V is the difference between the charge potential at high temperature and humidity (28° C. and 85% RH) and the charge potential at low temperature and humidity (10° C. and 30% RH). In the above-mentioned embodiment (the case of FIG. 5), as shown in FIG. 8, if the ambient condition is changed from the high temperature/humidity to the low temperature/humidity, the tops (or the bottoms) of the variation of the charge potential caused by the primary charging operation exceed the charge potential (−740 V) caused by the secondary charging operation. Accordingly, the average value of the charge potential correspondingly approaches to the target potential (−780 V). Thus, the stabilization of the charge potential on the photoreceptor is secured. The stabilization effect of the charge potential is similarly secured also when the surface film thickness of the photoreceptor is reduced. In the conventional art (Published Unexamined Japanese Patent Application No. Hei. 6-95478) already stated, the charge potential stabilization effect against the ambient temperature variation is only the formation of the average potential close to a desired charge potential, and unsatisfactory since the variation of the charge potential, which varies at the frequency corresponding to the frequency of the AC component, is still left.

Figure 9:
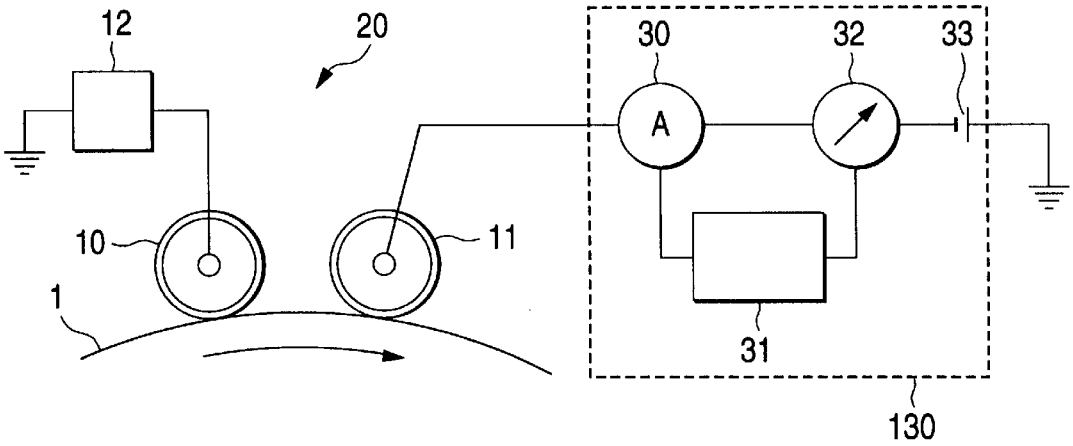
FIG. 9 is a diagram showing another embodiment of a charging device according to the present invention.

FIG. 9 is a diagram showing another embodiment of a charging device according to the present invention. The construction of a charging device 20 of the present embodiment is substantially the same as the charger unit 2 except that a second-charger power source 130 is made up of a current detecting circuit 30, a control circuit (CPU) 31, and a voltage varying device 32. In the figure, reference numeral 33 designates a DC power source.

The charging device 20 of the embodiment controls the voltage applied to the second charging roll 11 in the following manner.

Figure 10:
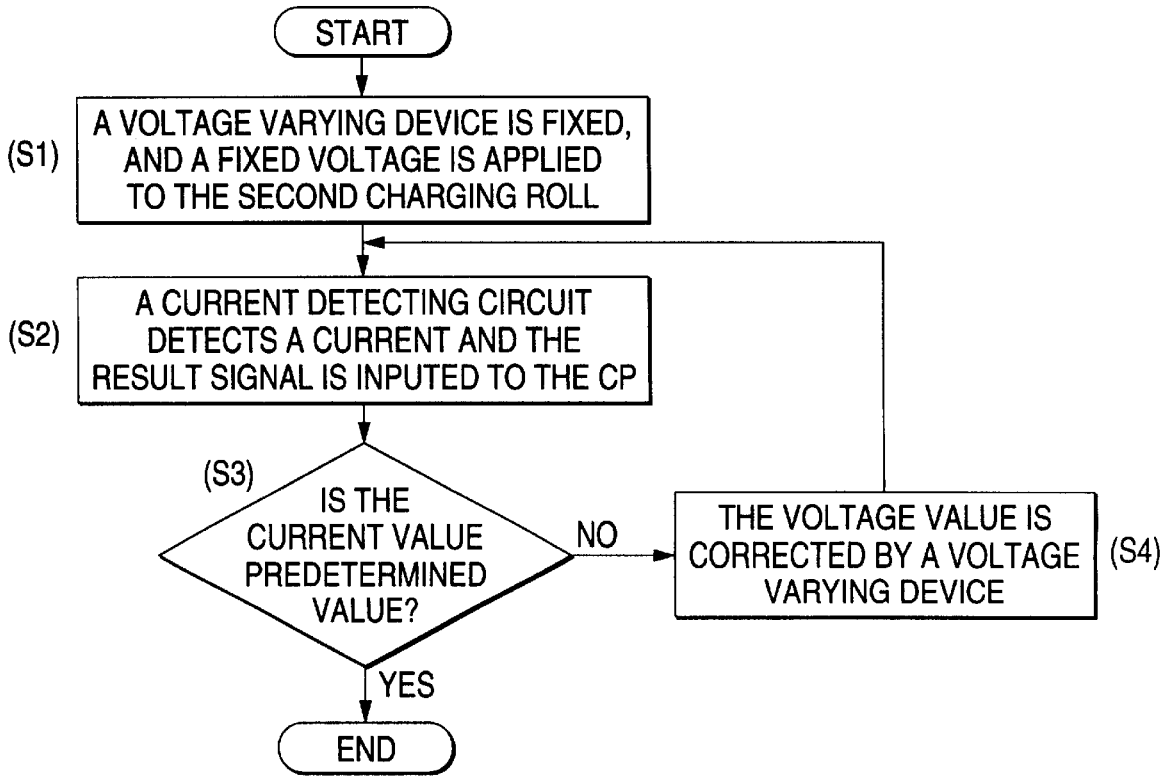
FIG. 10 is a flowchart showing a process of controlling the voltage applied to the second charging roll in the charging device of FIG. 9.
Figure 11:
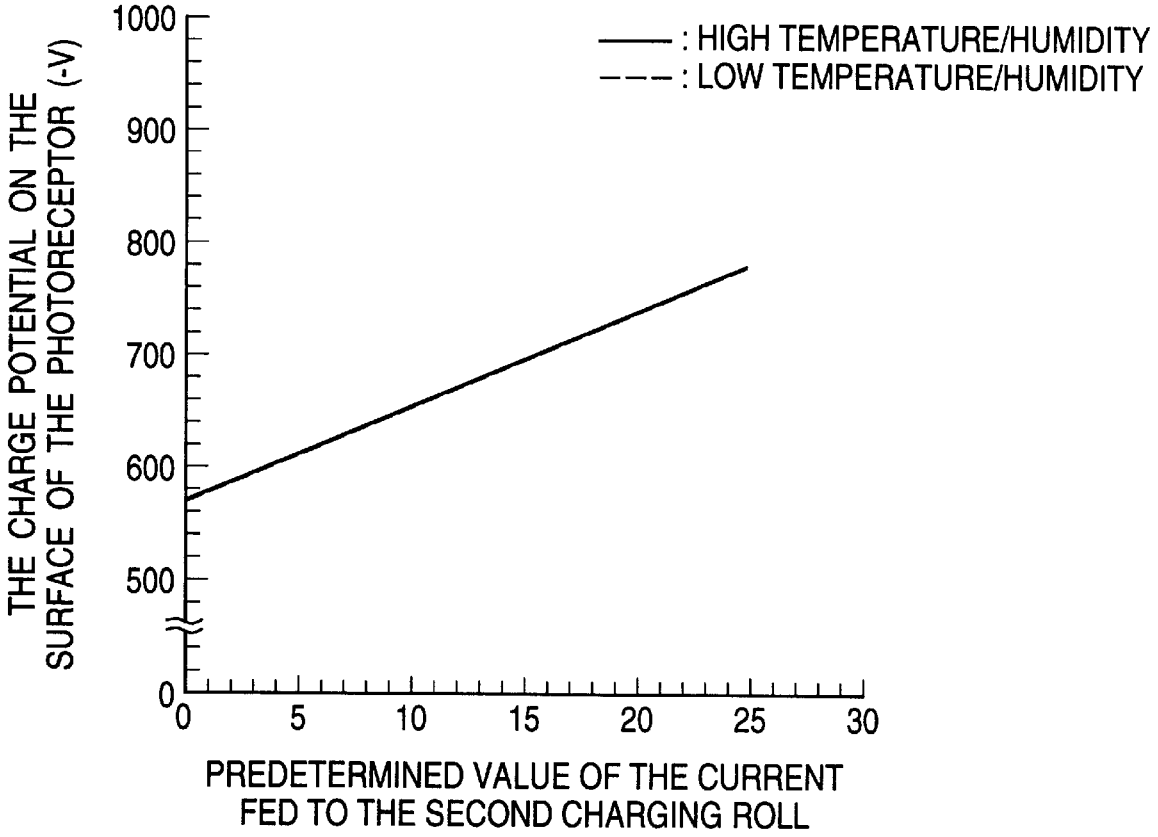
FIG. 11 is a graph showing a relationship between the charge potential on the surface of the photoreceptor and a predetermined value of the current fed to the second charging roll.

As shown in FIG. 10, the voltage varying device 32 is fixed at a predetermined voltage, and a fixed voltage is applied from the DC power source 33 to the second charging roll 11 (step S1). The current detecting circuit 30 detects a current flowing into the second charging roll 11, converts an analog signal representative of a detected current value into a digital signal, and inputs the digital signal to the control circuit 31 (step S2). The control circuit 31 judges whether or not the current value is a predetermined value (step S3). If the current value is not the predetermined value, the voltage value applied is corrected by the voltage varying device 32 (step S4). FIG. 11 is a graph showing a relationship between the charge potential on the surface of the photoreceptor and the predetermined value of the current fed to the second charging roll. As seen from the graph, the charge potential vs. current value relationship is substantially free from the ambient conditions of temperature and humidity. In this way, the applied voltage is controlled while monitoring the value of the current fed to the second charging roll. If the current value is equal to the predetermined value in the step S3, the process of controlling the applied voltage ends.

The control process for the voltage applied to the second charging roll, when carried out, more stabilizes the charge potential on the surface of the photoreceptor.

Figure 12:
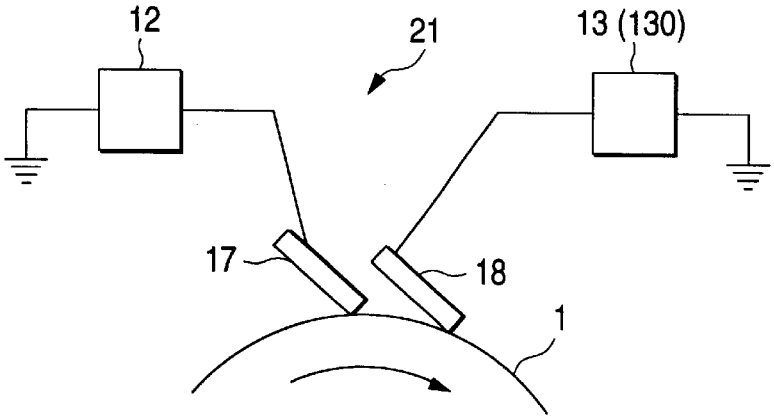
FIG. 12 is a diagram showing yet another embodiment of a charging device according to the present invention.

FIG. 12 is a diagram showing yet another embodiment of a charging device according to the present invention. A charging device 21 of the present embodiment has a construction which is substantially the same as of the first embodiment (FIG. 2) except that charging blades 17 and 18 are used in place of the first and the second charging rolls. Charging brushes or charging films may be substituted for the charging blades as the first and the second charging rolls. In the first embodiment (FIG. 2), the charging device 21 may be used in place of the charger unit 2.

Figure 13:
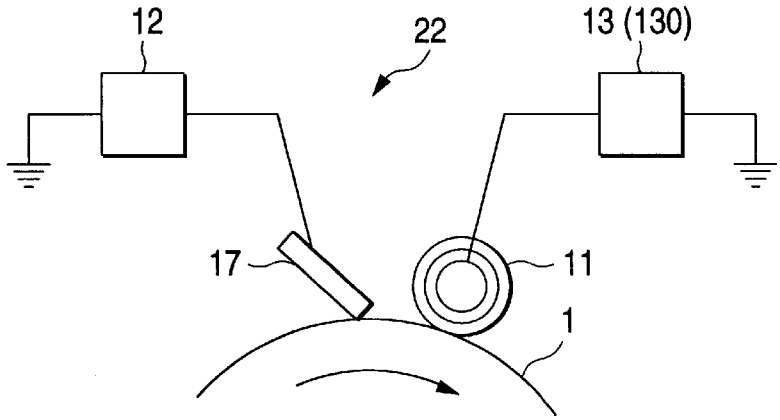
FIG. 13 is a diagram showing still another embodiment of a charging device according to the present invention.

FIG. 13 is a diagram showing still another embodiment of a charging device according to the present invention. A charging device 22 of the present embodiment has a construction which is substantially the same as of the first embodiment (FIG. 2) except that a charging blade 17 (brush or film) is used for the first charger, and the second charging roll 11, for the second charger. In the first embodiment (FIG. 2), the charging device 22 may be used in place of the charger unit 2. The reason why the second charging roll 11 is used for the second charger is that the second charging roll 11 is able to more uniformly charge the surface of the photoreceptor than the charging blade or the like. In the present embodiment, the first charger is formed with the charging blade, which is inexpensive, and the charging roll is formed with the charging roll, which provides a uniform charge potential. Therefore, the charge potential is stabilized and the cost reduction of the charging device is realized.

In the embodiments described above, two contact charging devices are used for the first and the second chargers, respectively. In a modification of the embodiment shown in FIG. 1, one of the charging rolls 10 and 11 is used. The photoreceptor 1 is turned two times for charging the surface thereof. In the first turn of the photoreceptor, the primary charging operation is carried out, and in the second turn, the secondary charging operation is carried out. In the first embodiment, the transfer roll 5 or the cleaning blade 6a may be used for the charging roll 10 as a contact charging means for the primary charging.

Figure 14:
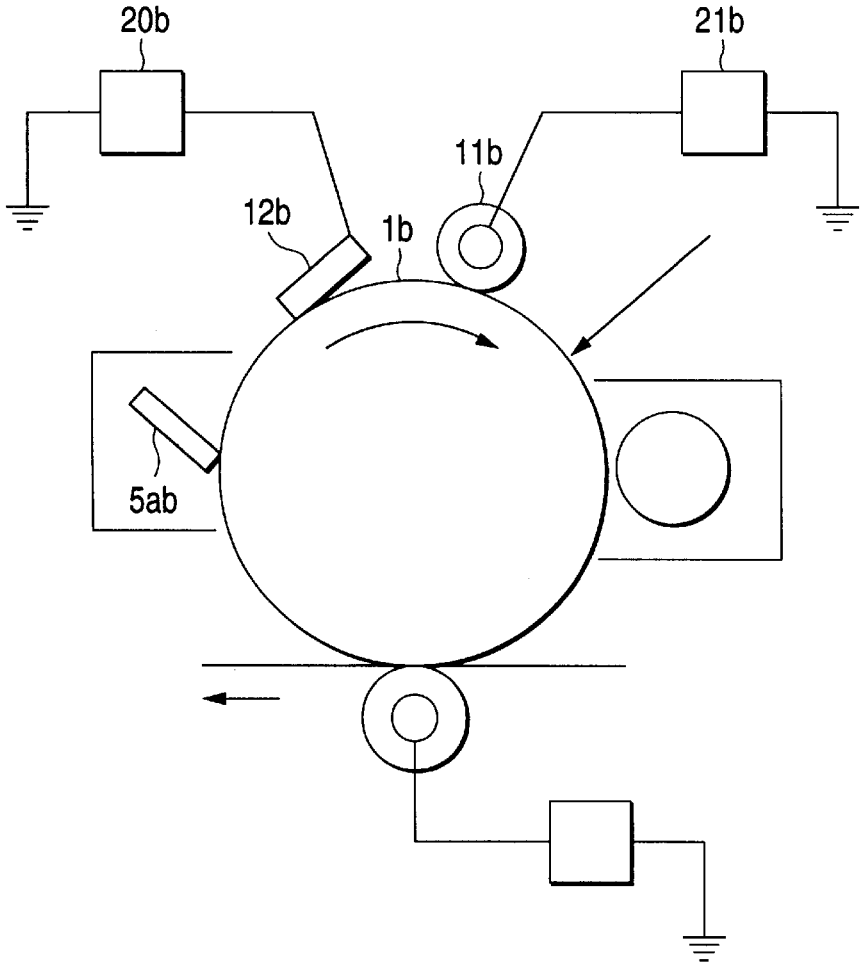
FIG. 14 is a diagram showing an electrophotographic copying machine into which a charging device according to an embodiment of the present invention is incorporated.

A test was conducted by the inventors in order to confirm the effects of the charging device using the contact charging blade and the charging roll 11*b*. For the experiment, an image forming apparatus as shown in FIG. 14 was manufactured. In the experiment, soiling of the contact charging blade 12*b* and the charging roll 11*b*, and the quality of the formed image were examined.

In the test, the photosensitive layer of the photoreceptor 1*b* was an organic photoreceptor, which is sensitive to the rays of light in an infrared rays region. A rotation speed, i.e., a process speed, of the photoreceptor 1*b* was 300 mm/s. A voltage applied to the first charging blade 12*b* by a power source 20*b* consisted of a DC voltage of −660 V and an AC voltage of 1500 Vp-p and at 500 Hz superposed on the DC voltage. A DC voltage applied to the second charging roll 11*b* by a power source 21*b* was −1350 V (discharge start voltage: −600 V).

In the initial stage, the contact charging blade 12*b* and the charging roll 11*b* are clean. Accordingly, a uniform charge may be secured and a high quality image may be formed by any combination of the first contact charger and the second contact charger other than the combination of the contact charging blade 12*b* and the charging roll 11*b*, employed in the present embodiment. Those combinations are, for example, the combination of the charging rolls, the combination of the charging roll and the charging blade, and the combination of the charging roll and the charging brush.

The process speed of the image forming apparatus used in the test was high, 300 mm/s. Because of this, a relatively large amount of toner is left on the photoreceptor surface after the cleaning process since there are toner left as the result of unsatisfactory cleaning by the cleaning blade 5*ab* for cleaning the photoreceptor 1*b* and toner having passed the cleaning stage without undergoing the cleaning process. With repeating the image forming operation, toner will be frequently attached to the contact charger applied with the DC voltage where some combination of the contact chargers is used.

Figure 15:
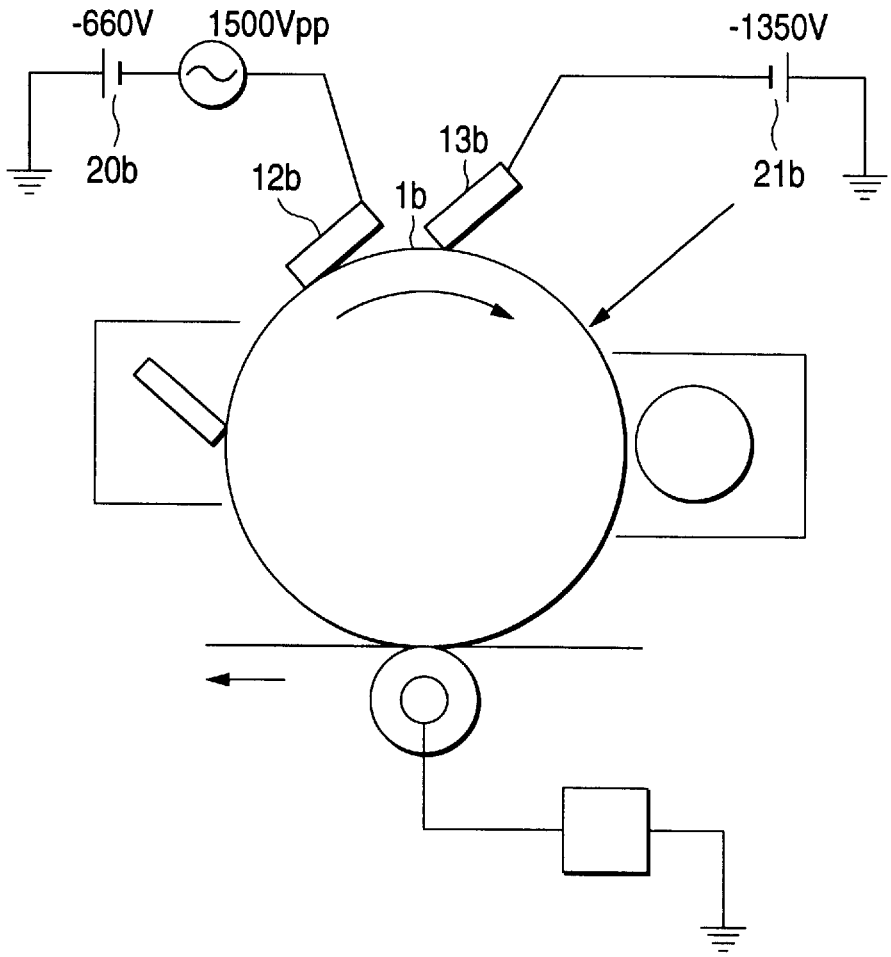
FIG. 15 is a diagram showing an electrophotographic copying machine comparatively used for a test.

The combinations of the first and the second contact chargers were tested for comparatively examining soils on the chargers. Those combinations are the combination of the charging blade 12*b* and the charging blade 13*b*, and the combination of the first charging roll 10*b* and the charging roll 11*b* shown in FIGS. 15 and 16, in addition to the combination of the contact charging blade 12*b* and the charging roll 11*b*.

Under the conditions described above, an endurance test was conducted by a 10-sheet intermittent print method (in which the consecutive printing of ten sheets and the rest of the printing are repeated). The results of the endurance test, i.e., soils on the first and the second contact chargers and the qualities of the printed pictures, are shown in FIG. 17.

Figures 16, 17:
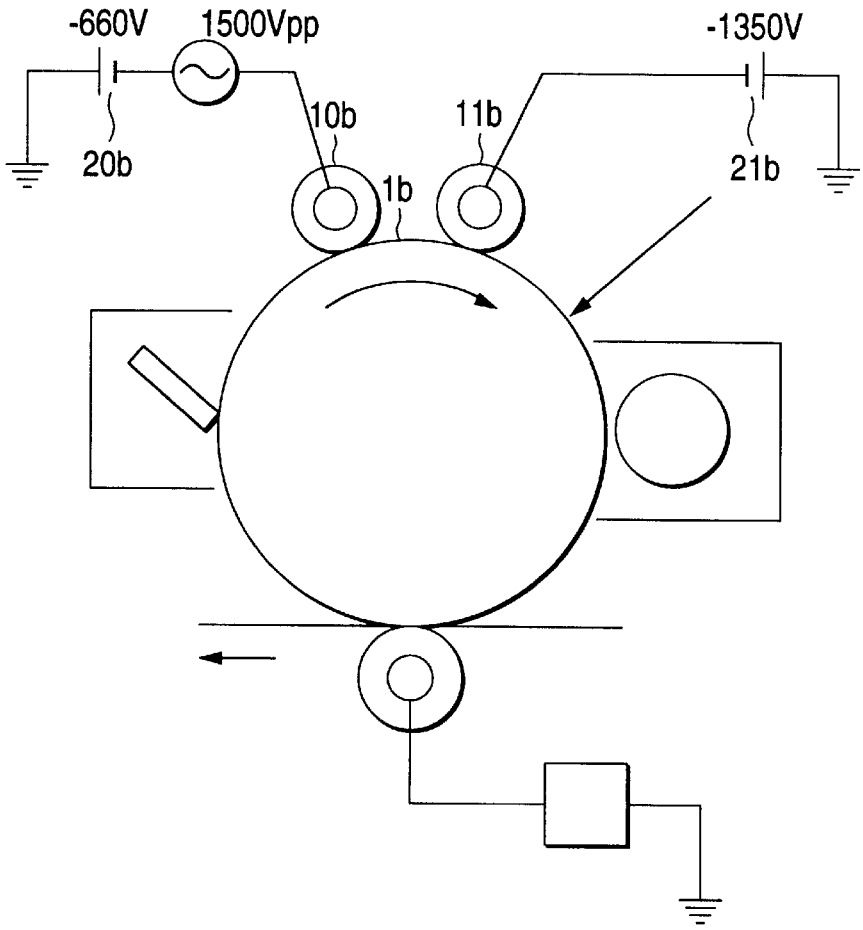
FIG. 16 is a diagram showing another electrophotographic copying machine comparatively used for the test.
FIG. 17 is a Table showing the results of the test.

As seen from FIG. 17, in the combination of the charging roll 10*b* and the charging roll 11*b*, soil was remarkable on both the charging rolls, and fog was observed on the printed picture.

In the combination of the contact charging blade 12*b* and the charging blade 13*b*, soil was unobtrusive on both the charging blades, and white stripes appeared and black dots locally appeared on the printed picture.

In the combination of the contact charging blade 12*b* and the charging roll 11*b*, soil was unobtrusive on both the charging rolls as in the combination of the blades 12*b* and 13*b*, but the picture quality was better than that in the former case and satisfactory for practical use.

Evaluation of the results of the endurance test follows. Since the AC-DC combined voltage is applied to the first contact charger, the direction of an electric field in the vicinity of the nip between the first contact charger and the photoreceptor drum is alternatively changed. Accordingly, foreign materials, for example, toner, attach to the first charging roll but it is instantly detached from the roll at the next moment. The first charging blade 12*b* removes most of the soil of the toner having passed the cleaning stage without undergoing the cleaning process. In this respect, it is effective to use the charging blade for the first contact charger. However, where the process speed is high, 300 mm/s, a minute amount of toner is left after passing the contact charging blade 12*b*. The toner, although its amount is minute, attaches to the downstream contact charger applied with the DC voltage.

In charging the surface of the photoreceptor drum under the applied DC voltage, a discharge taking place on a minutely soiled portion of the drum surface is frequently abnormal, so that a potential on that portion of the drum surface is extremely higher than a desired potential (abnormal discharge). Particularly in the case, used for comparison, where the charging blade is used for the downstream charger, the charger is a contact charger of the fixed type. Therefore, a stripe-like high potential part appears when an abnormal discharge takes place on the soiled portion. This will appear in the form of a white stripe on the printed picture in the case where the charging blades are combined. In the case where the charging roll is used for the downstream charger, the charger is a contact charger of the rotary type. Therefore, a minute soil causes an abnormal discharge on the soiled portion, so that a white spot appears on the printed picture. The white spot is frequently invisible to the naked eye, however. In the combination of the charging roll and the charging blade, the printed image will less suffer from defects, for example, the white stripe, than in the former combination.

When the charging operation is improper on the soiled portion of the contact charger, the potential on the surface of the photoreceptor drum 1*b* is lowered, so that a fog appears on the printed picture. In case where the discharging area is sufficiently broad as in the case of using the charging roll, the soiled portion undergoes a discharge which takes place on the clean portion or the portion not soiled, for a long time. Accordingly, it is possible to uniformly charge the photoreceptor surface. Where the discharging area is narrow, the soiled portion undergoes an insufficient discharge taking place on the clean portion. Accordingly, it is difficult to uniformly charge the photoreceptor surface. In the former combination, the two charging blades, unlike the charging roll, which cannot secure sufficiently large discharging areas are used. For this reason, the portion where the potential is decreased will appear as a black dot on the printed picture. In the latter combination, the charging roll having a broad charging area is used for the second contact charger. Therefore, the picture defect, for example, black dots, are more hardly caused than in the former combination.

As seen from the description thus far made, in the case of the charging device which has two contact chargers and operates at the medium and high speeds, e.g., 250 mm/s or higher, in order to uniformly charge the photoreceptor surface, it is necessary to use the charging blade for the first contact charger and the charging roll for the second contact charger. It is readily seen that the construction described above is preferable also when the process speed is 250 mm/s or lower.

Further, the frequency of an AC voltage, on which a DC voltage is superposed to form a voltage applied to the first contact charging blade 12*b* for the primary charging operation, is selected to be low to such an extent as not to affect the noise by the vibration of the photoreceptor drum 1*b* and the reduction of the film thickness of the photoreceptor. To remove the charge potential variation which results from the primary charging operation and of which the pitch corresponds to the AC voltage, such a DC voltage as to vary at least a part of a pattern of charge potential variation up to a potential beyond the discharge start voltage is applied to the charging roll 11*b*. Therefore, the noise by the vibration of the photoreceptor drum 1*b* is not generated, the abrasion of the photosensitive layer of the photoreceptor drum 1*b* is not promoted, and the photoreceptor surface is uniformly charged.

As described above, a charging device having two contact charging means, which charge the surface of an image bearing means while in contact with the surface thereof, characterized in that a charging blade is used for a contact charger located upstream when viewed in the moving direction of the image bearing means, and a charging roll is used for a downstream contact charger, a charging blade, applied with a voltage consisting of an AC voltage and a DC voltage superposed on the AC voltage, is used for a contact charger located upstream when viewed in the moving direction of the image bearing means, and a charging roll is used for a downstream contact charger, the image bearing means is primarily charged by applying a voltage consisting of an AC voltage and a DC voltage superposed on the AC voltage to the charging blade as an upstream contact charger, and such a DC voltage as to vary at least a part of a pattern of charge potential variation of which the pitch corresponds to the AC voltage, caused in the primary charging operation, through a discharging operation to be caused by the DC voltage per se is applied to the charging roll as a downstream contact charger. With such a construction, the charging operation is smoothly performed without any interruption by the toner left after the cleaning process by the cleaning blade, for example, additively applied agents, paper powder, and the like. Also in the medium or higher speed machines of 250 mm/s or higher in process speed and hence having a relatively large amount of toner left after the cleaning process, the smooth charging operation and the charge uniformity are secured for a long time.

In the charging device of the present embodiment, the edge of the charging blade is brought into the image bearing means in a state that it is slanted in the counter direction.

Figures 18, 19:
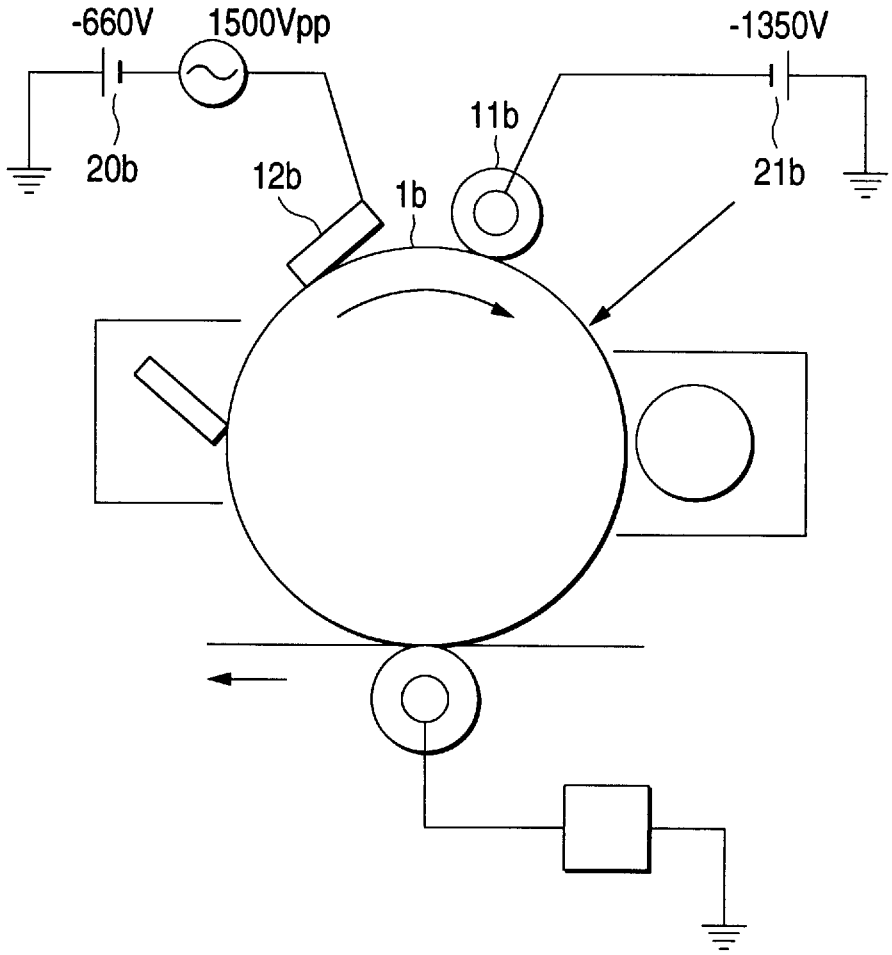
FIG. 18 is a diagram showing an electrophotographic copying machine into which a charging device according to a third embodiment the present invention is incorporated.
FIG. 19 is a Table showing the results of a test.
Figure 20:
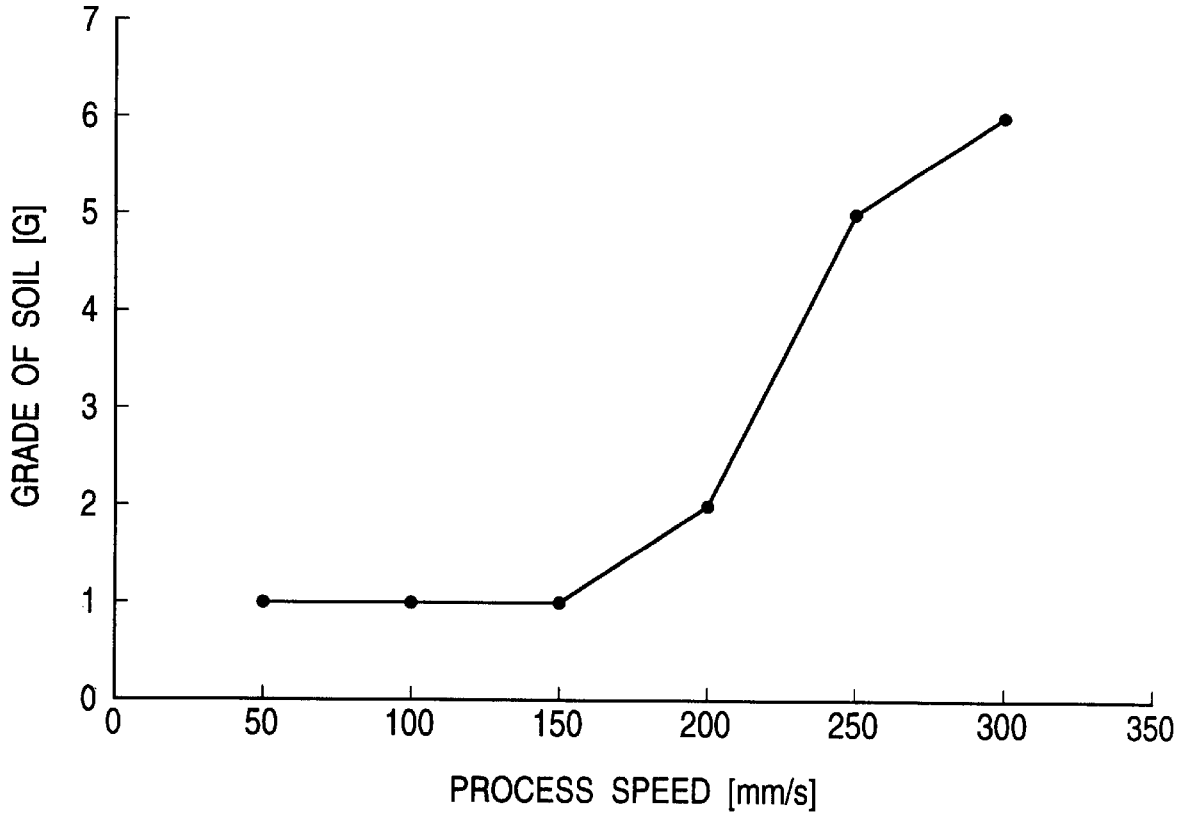
FIG. 20 is a graph showing a variation of soil on the charging roll with respect to a process speed.
Figure 21:
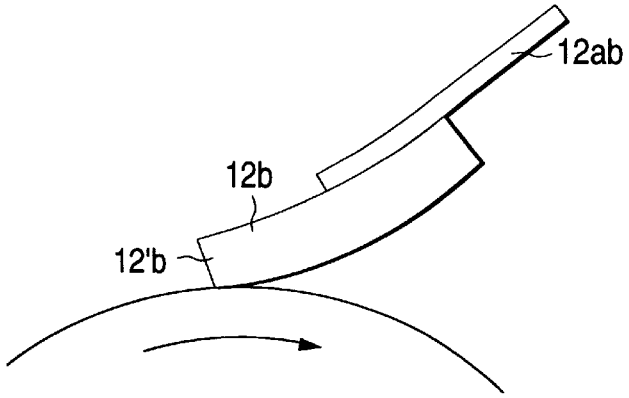
FIG. 21 is a diagram showing a charging blade according to an embodiment of the present invention.
Figure 22:
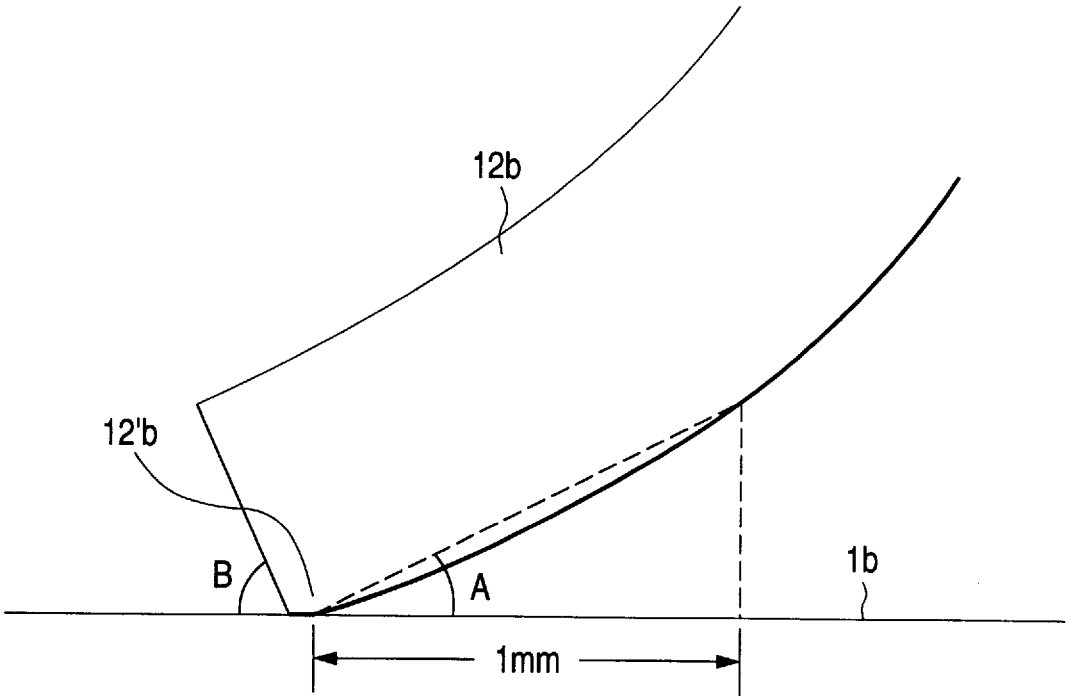
FIG. 22 is a diagram showing a key portion of the charging blade.

As best illustrated in FIGS. 18 and 21, the contact charging blade 12*b* as a called doctor blade is disposed such that the contact charging blade 12*b* is located downstream of the edge 12'*b* thereof in contact with the photoreceptor drum 1*b*, when viewed in the rotating direction of the photoreceptor drum 1. More specifically, since the contact charging blade 12*b* as a called doctor blade is disposed such that the contact charging blade 12*b* is located downstream of the edge 12'*b* thereof in contact with the photoreceptor drum 1*b*, when viewed in the rotating direction of the photoreceptor drum 1*b*, a contact angle A of the contact charging blade 12*b* to the length of 1 mm of the surface of the photoreceptor drum 1*b*, which is located downstream of the contact point of them when viewed in the rotating direction of the drum, as shown in FIG. 22, is smaller than an angle B of the contact charging blade 12*b* to the photoreceptor drum 1*b*, which is located upstream of the contact point.

Figure 23:
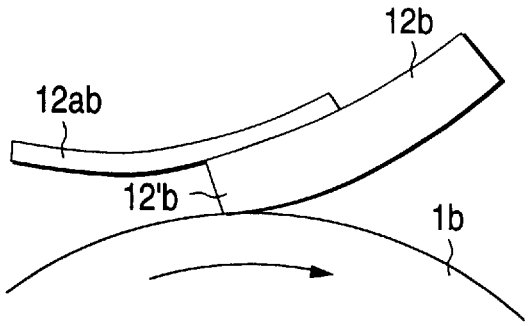
FIG. 23 is a diagram showing a charging blade according to another embodiment of the present invention.

If the contact charging blade 12*b* is located downstream of the edge 12'*b* thereof in contact with the photoreceptor drum 1*b*, when viewed in the rotating direction of the photoreceptor drum 1*b*, a thin plate 12ab for supporting the contact charging blade 12*b*, as shown in FIG. 23, may be provided at an upstream location in a state that it is bent as required.

Figure 24:
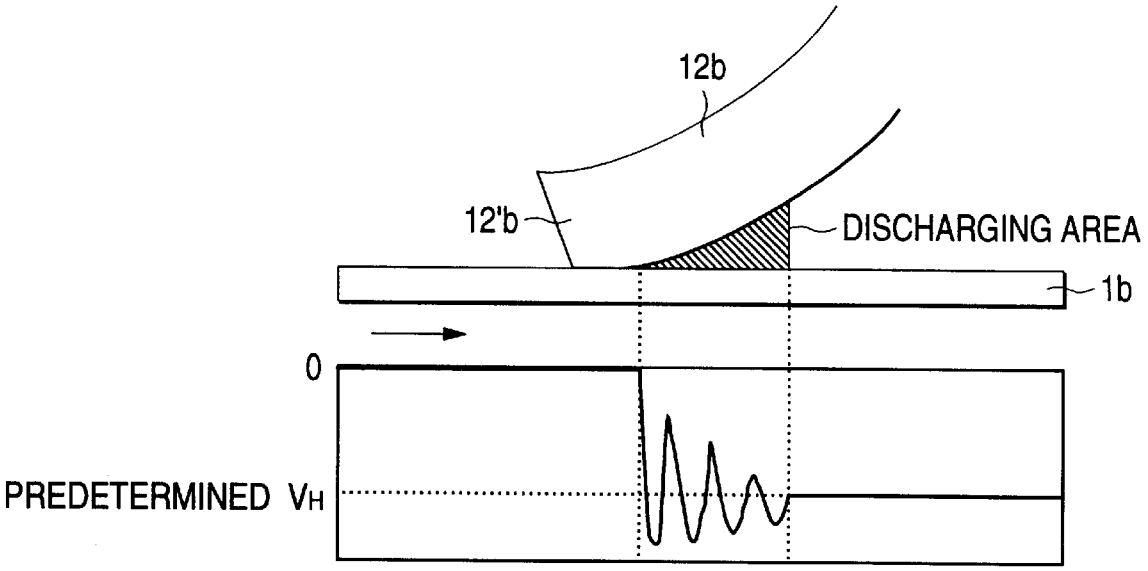
FIG. 24 is an explanatory diagram showing a charging state by a charging blade according to a second embodiment of the present invention.

In the present embodiment using the contact charging blade 12*b*, a gap defined by the contact charging blade 12*b* and the photoreceptor drum 1*b* gradually increases to the downstream, as shown in FIG. 24. Therefore, a discharge in the gap between the blade 12*b* and the drum 1*b* will stop when the voltage applied between them drops below the discharge start voltage. In other words, a discharge in the gap between the contact charging blade 12*b* and the photoreceptor drum 1*b* is determined by the voltage applied to the contact charging blade 12*b*. The discharge ends only when it falls under a predetermined condition. Accordingly, the charge potential on the surface of the photoreceptor drum 1*b* is kept at a fixed value.

Figure 25:
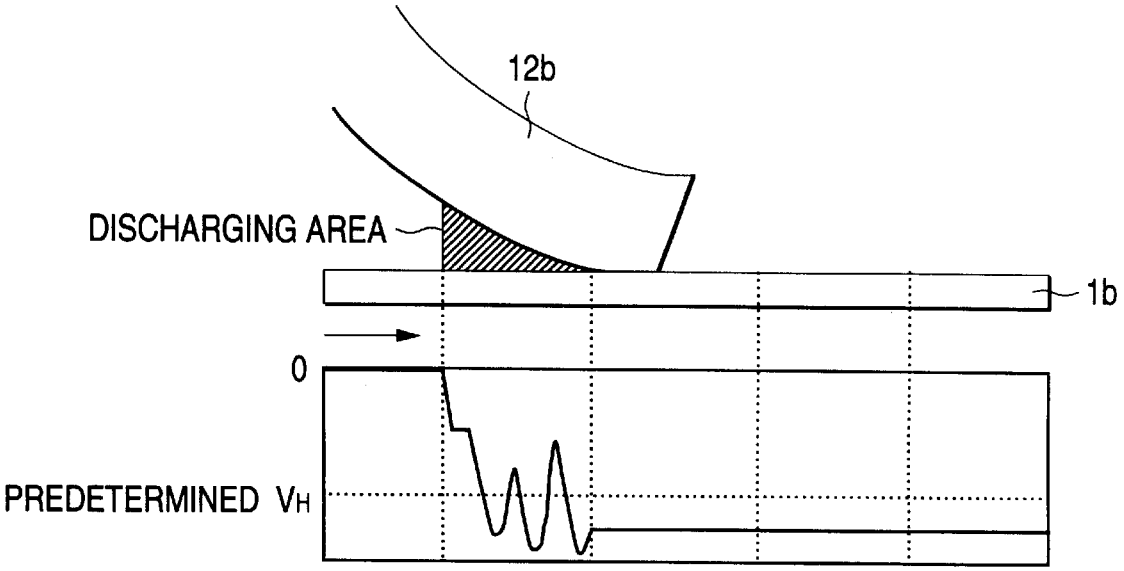
FIG. 25 is an explanatory diagram showing a charging state by a charging blade used for comparative purpose.

A case where a called wiper blade is used for the contact charging blade 12*b* follows. In this case, a gap between the contact charging blade 12*b* and the photoreceptor drum 1*b* gradually decreases to the downstream as shown in FIG. 25. A discharge in the gap between the contact charging blade 12*b* and the photoreceptor drum 1*b*, once it starts, continuously takes place under a voltage higher than the discharge start voltage. Therefore, the charge potential on the photoreceptor drum 1*b* depends on a state of the discharge when the discharge ends. In the discharge state at its end, the discharge is most easy to occur. This state is very sensitive to a surface state of the photoreceptor drum 1*b* and the AC component of the applied voltage. In this state, it is difficult to uniformly charge the surface of the photoreceptor drum 1*b*.

An experiment and calculations were carried out by the inventors to confirm the useful effects of the charging blade. To this end, a voltage consisting of an AC voltage superposed on a DC voltage was applied to the charging blade 12*b*. In this state, a state of a discharge occurring in a gap between the contact charging blade 12*b* and the photoreceptor drum 1*b* was carefully observed, with related calculations.

Figure 26A:
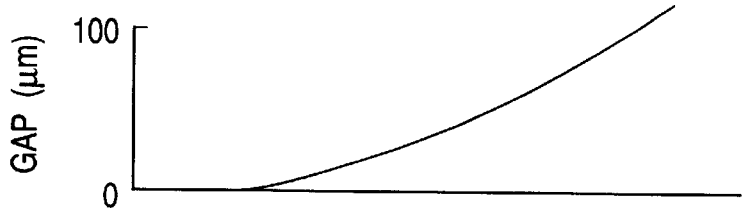
FIGS. 26A to 26D show a charging state by the charging blade of the invention.
Figure 26B:
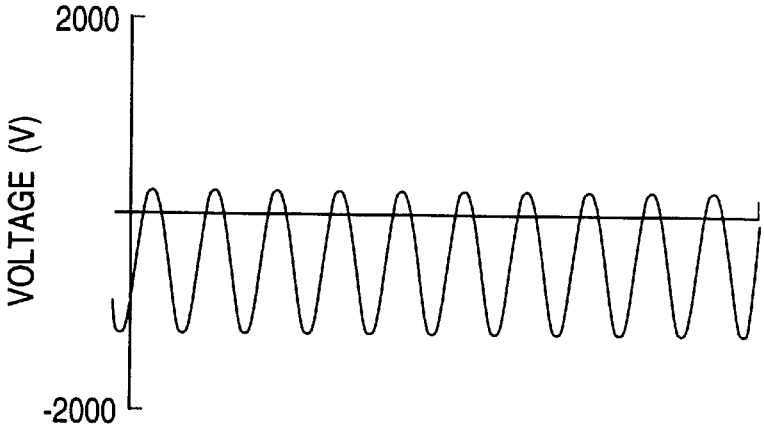
Figure 26C:
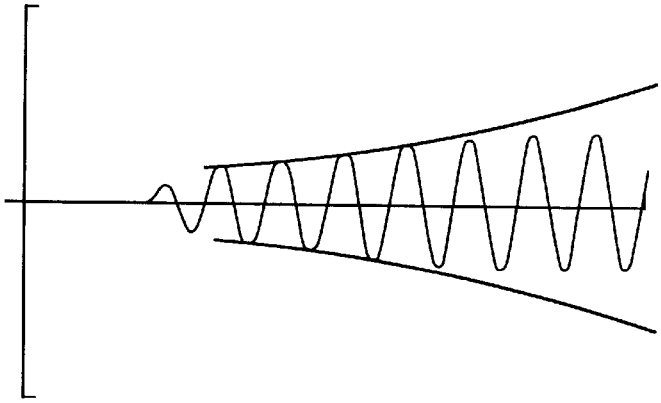
Figure 26D:
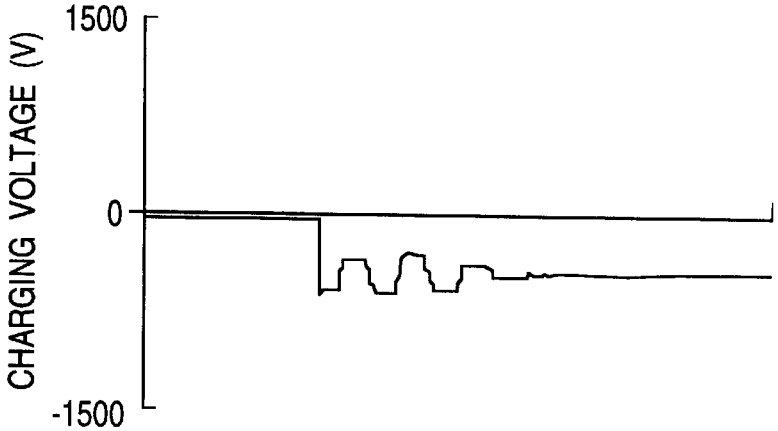

A gap between the contact charging blade 12*b* and the photoreceptor drum 1*b* was defined by a circular arc of 7 mm in curvature radius, as shown FIG. 26A. An AC component and a DC component of the voltage applied to the contact charging blade 12*b* were respectively 1500 Vp-p and 2000 Hz, and −500 V, as shown in FIG. 26B. FIG. 26C shows a threshold value A at which a discharge starts, obtained by Paschen's law, and a voltage B applied between the contact charging blade 12*b* and the photoreceptor drum 1*b*. As seen, a point where the voltage B exceeds the threshold value A, a discharge starts to charge the photoreceptor drum 1*b*. As seen from FIG. 26D, a potential on the surface of the photoreceptor drum 1*b* is settled down at a fixed value, and the drum surface is charged at a predetermined potential.

Figure 27A:
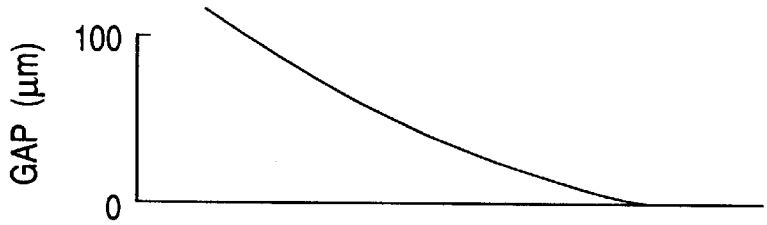
FIGS. 27A to 27D show a charging state by the charging blade used for comparison.
Figure 27B:
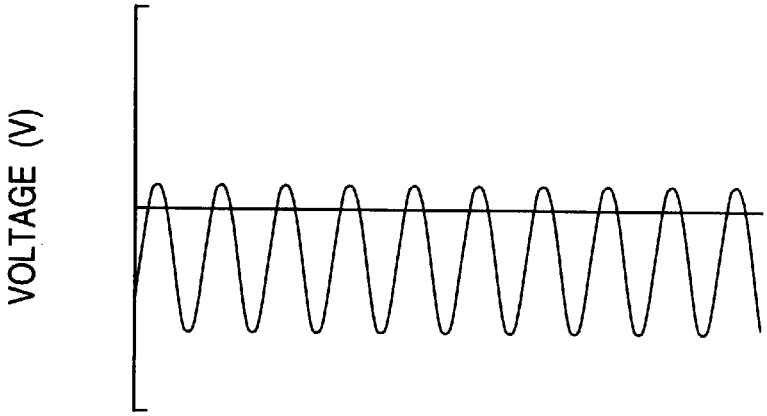
Figure 27C:
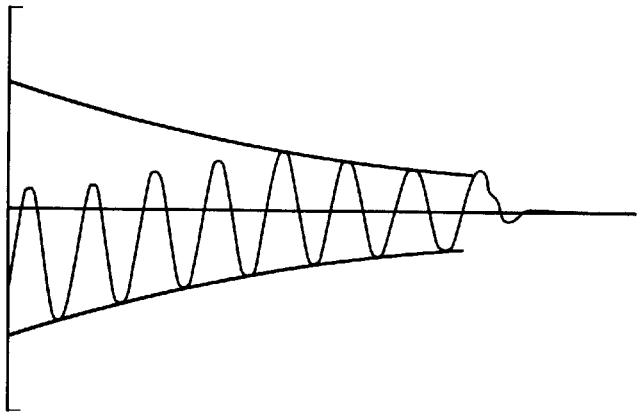
Figure 27D:
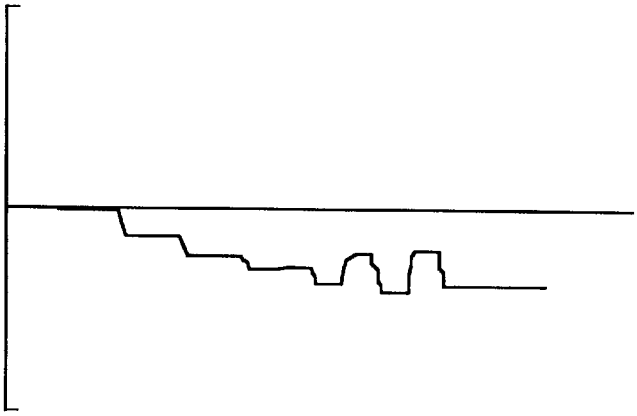

In the case of the contact charging blade 12*b* of the wiper blade type, a discharging state is instable as shown in FIGS. 27A to 27C.

As described above, in the second embodiment, the edge 12'*b* of the charging blade 12*b* is brought into contact with the photoreceptor drum 1*b* in a state that it is slanted in the counter direction, and the charging blade of the doctor blade type is used for the contact charging blade 12*b*. A discharge occurs in the gap between the contact charging blade 12*b* and the photoreceptor drum 1*b*, located downstream of the contact point of them. When an AC voltage is applied to the contact charging blade 12*b*, the gap located downstream of the contact charging blade 12*b* gradually increases to the downstream. A discharge starts in the gap between the contact charging blade 12*b* and the photoreceptor drum 1*b* at a point where the DC voltage with the AC voltage superposed thereon, applied to between them. As a result, after it passes the contact charging blade 12*b*, the surface potential of the photoreceptor drum 1*b* tends to be settled down at a desired potential. As a result, the charge potential becomes constant in value.

With such a construction that the edge 12'b of the charging blade 12b is brought into contact with the photoreceptor drum 1b in a state that it is slanted in the counter direction, and the charging blade of the doctor blade type is used for the contact charging blade 12b, the toner left after the cleaning process by the cleaning blade is more effectively reduced than in the charging blade of the wiper type. Accordingly, the charging roll 11b located downstream is less soiled.

A charging device of the present embodiment having a first charger (2c) for primarily charging an image bearing means when it receives a voltage consisting of a DC voltage superposed on an AC voltage, and a second charger (10c) for secondarily charging the image bearing means when it receives such a voltage as to vary at least a part of a pattern of charge potential variation, of which the pitch corresponds to the frequency pitch of the AC component, caused in the primary charging operation by the first charger through the discharging operation to be caused by the DC voltage per se. In the charging device, a blade member is used for the first charger. The blade member includes a semiconductor portion for discharging an image bearing means when the semiconductor portion receives a bias voltage, and an insulating portion brought into contact with the image bearing means to position the semiconductor portion so as to be spaced apart from the surface of the image bearing means to form a small gap therebetween.

Figure 28A:
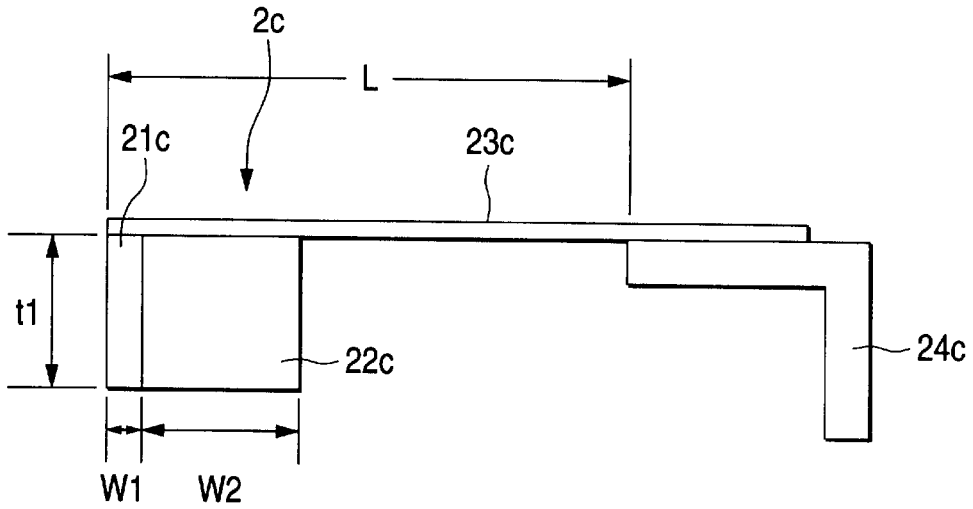
FIG. 28A shows the construction of a charging device according to an embodiment of the present invention.
Figure 28B:
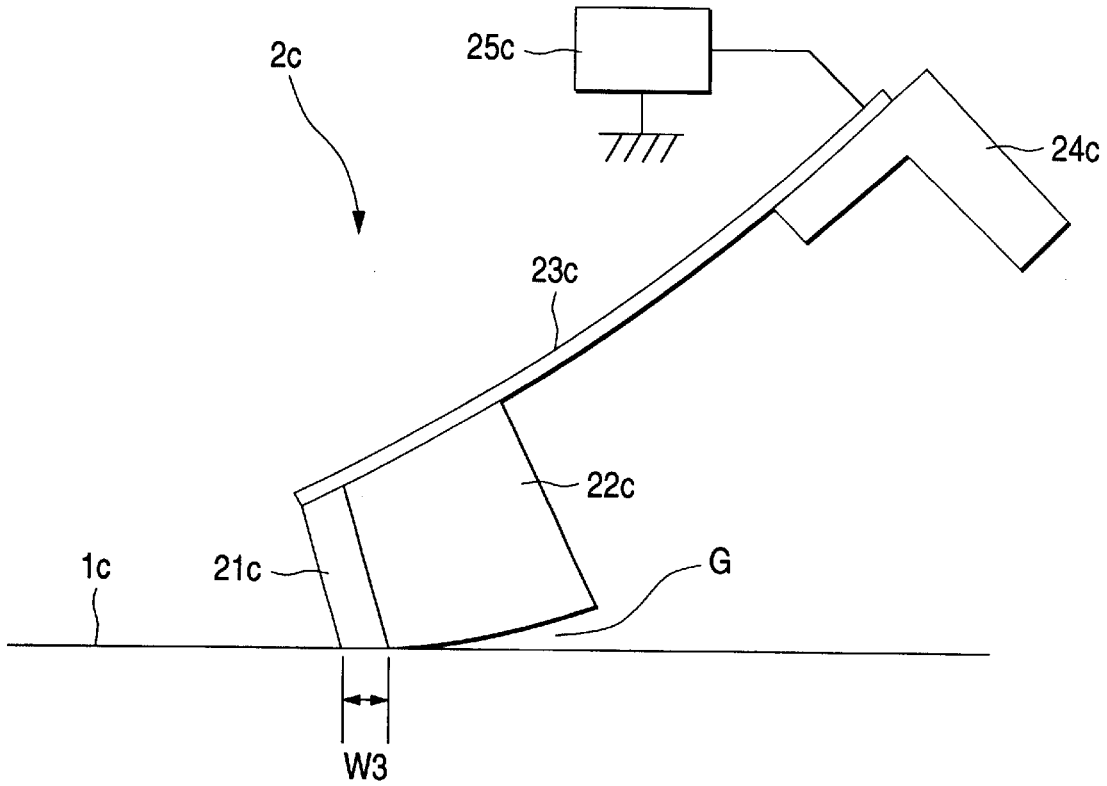
FIG. 28B shows a state of the charging device when it is used.

FIG. 28A shows a structure of the first charger. FIG. 28B shows a state of the first charger when it is brought into contact with a photoreceptor drum.

The contact charger 2c of the blade type includes an insulating portion 21c attached to the tip of the charger where the charger is brought into contact with the photoreceptor drum 1c. The volume resistivity of a material of the insulating portion 21c is $10^{10}$ Ω·cm or larger, more preferably $10^{12}$ Ω·cm or larger. In the present embodiment, urethane rubber is used for the insulating portion in the light of wear proof. Another material, such as SBR (styrene-butadiene rubber), BR (butadiene rubber), EPDM, or silicone rubber, may be used for the insulating portion. The width W1 of the insulating portion 21c when viewed in the process direction is approximately 0.01 mm to 2.00 mm. A value within a range of approximately 0.1 mm to 1.0 mm is more preferable for the width W1, to secure a gap proper to a discharge between the semiconductor portion 22c and the photoreceptor drum 1c. The thickness t1 of each of the insulating portion 21c and the semiconductor portion 22c is approximately 1 mm to 5 mm.

In the contact charger 2c, the semiconductor portion 22c is layered on the rear side of the insulating portion 21c. The volume resistivity of a material of semiconductor portion 22c is approximately $10^3$ Ω·cm to $10^{10}$ Ω·cm, and more preferably approximately $10^4$ Ω·cm to $10^7$ Ω·cm in the light of the charge uniformity. The semiconductor portion 22c is made of a material formed by dispersing an electron conductifying agent, for example, carbon, into urethane rubber for adjusting its resistivity. other materials available for the semiconductor portion 22c are a material formed by dispersing an electron. conductifying agent, for example, carbon, into EPDM rubber, a material formed by adding an ion conductifying agent, for example, $LiClO_4$, to urethane rubber, a material formed by dispersing an electron conductifying agent, carbon and an ion conductifying agent, for example, $LiClO_4$, to urethane rubber, and the like. The width W2 of the semiconductor portion 22c as viewed in the process direction is approximately 1 mm to 10 mm.

The insulating portion 21c and the semiconductor portion 22c may be formed in a manner that a material of the insulating portion 21c is formed into a thin layer of the thickness corresponding to the width W1 as viewed in the process direction, a material of the semiconductor portion 22c is layered on the insulating portion 21c up to the thickness thereof corresponding to the width W2 as viewed in the process direction, and the layered structure is cut into a product having a predetermined thickness t1 and a predetermined length.

A conductive supporting member 23c is bonded onto the rear side of the structure of the insulating portion 21c and the conductive supporting member 23c by a bonding means, for example, conductive adhesive. The conductive supporting member 23c may be a thin plate made of SUS, phosphorus bronze, or the like. The thickness of the conductive supporting member 23c is selected so as to have a desired elasticity. It is preferably within a range of approximately 0.02 mm to 0.2 mm in consideration with a contact pressure to the photoreceptor drum 1.

The thus constructed contact charger 2c, as shown in FIG. 28B, is mounted above the photoreceptor drum 1c so that a contact width W3 of the contact charger 2c to the photoreceptor drum 1c is narrower than the width W1 of the insulating portion 21c. When the contact charger 2c is so mounted, the insulating portion 21c is brought into contact with the photoreceptor drum 1c, and the contact charger 2c is positioned such that the semiconductor portion 22c is spaced apart from the surface of the photoreceptor drum 1c and a gap G between it and the surface of the photoreceptor drum 1c grows to the right in the drawing.

The conductive supporting member 23c, as shown in FIG. 28B, is fastened to a holder 24c, which is mounted on a frame (not shown) for supporting the photoreceptor drum 1c. In the contact charger 2c, a bias source 25c is electrically connected to the semiconductor portion 22c. The bias source 25c may be electrically connected to the conductive supporting member 23c or through the holder 24c to the same. A bias voltage from the bias source 25c consists of an AC voltage superposed on a DC voltage.

When the contact charger thus constructed is used for a long time, a resistive layer formed on the surface of the conductive member is little worn and provides a good electrical conduction at its contact with the image bearing means. Therefore, a good charge uniformity is secured.

Figure 29:
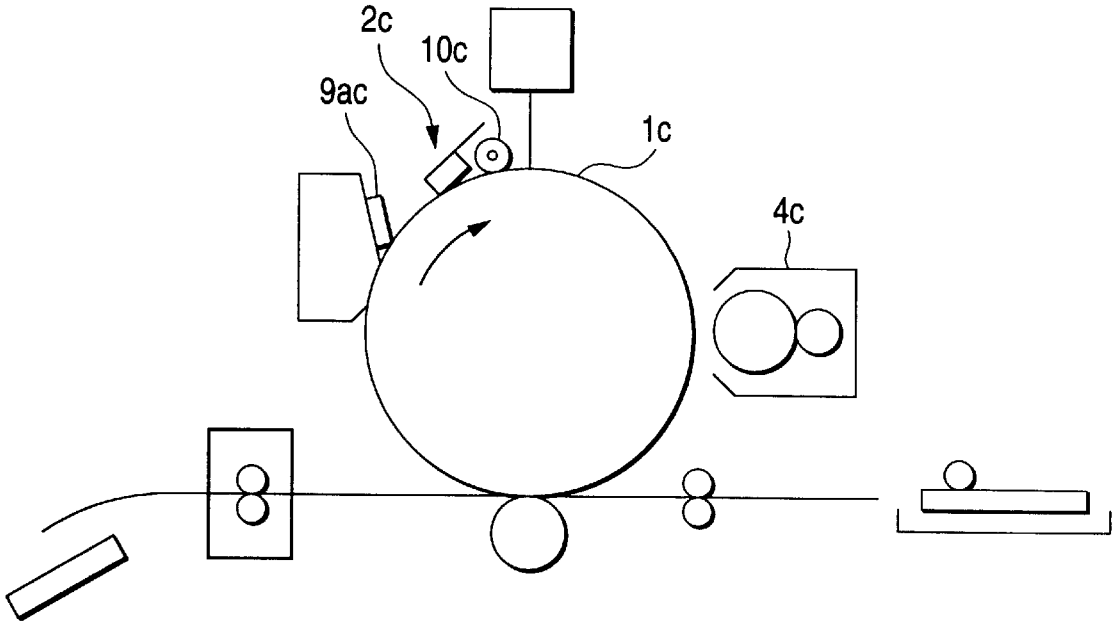
FIG. 29 is a diagram showing the construction of an electrophotographic copying machine into which the charging device of the invention is incorporated.
Figure 30:
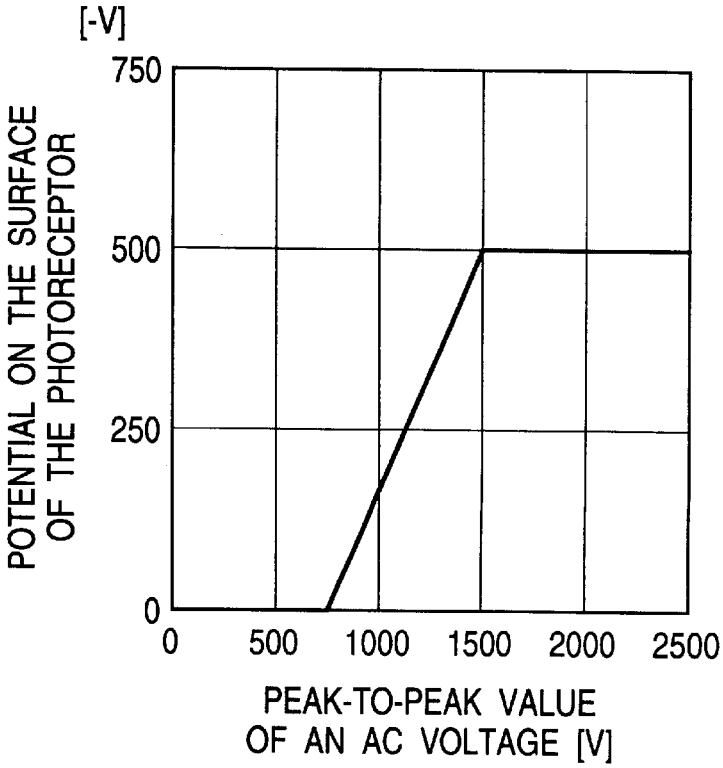
FIG. 30 is a graph showing a variation of a potential on the surface of a photoreceptor with respect to a peak-to-peak value of an AC voltage.

In the electrophotographic copying machine, as shown in FIG. 29, the surface of the photoreceptor drum 1c is charged by the first charger 2c applied with a voltage consisting of an AC voltage superposed on a DC voltage. Then, such a voltage as to vary at least a part of a pattern of charge potential variation, of which the pitch corresponds to the frequency pitch of the AC component, caused in the primary charging operation by the first charger through the discharging operation to be caused by the DC voltage per se, is applied to the second charger 10c. The first charger 2c, as shown in FIG. 28, includes the semiconductor portion 22c for discharging the photoreceptor drum 1c when it receives a bias voltage, the semiconductor portion 22c, the insulating portion 21c brought into contact with the photoreceptor drum 1c to position the semiconductor portion 22c so as to be spaced apart from the surface of the photoreceptor drum 1c to form a small gap G therebetween, and the conductive supporting member 23c located on the rear side of the structure of the insulating portion 21c and the conductive supporting member 23*c*, wherein a bias voltage is applied from the bias source 25*c* to the conductive supporting member 23*c*. In the first charger 2*c*, as shown in FIG. 28B, a discharge takes place in the gap G between the semiconductor portion 22*c* and the photoreceptor drum 1*c*, which grows to the right in the drawing. By the discharge, the surface of the photoreceptor drum 1*c* is charged at a predetermined potential. Subsequently, as shown in FIG. 29, a charging process by the second charger, an exposure process, a developing process, a transferring process, and the like are successively carried out, and finally an image is copied on a recording paper 6*c*.

Thus, in the first charger 2*c* according to the present embodiment, the semiconductor portion 22*c* for charging the photoreceptor drum 1*c* through a discharge taking place between the charger 2*c* and the photoreceptor drum 1*c* is coupled with the insulating portion 21*c*, which is brought into contact with the photoreceptor drum 1*c* to position the semiconductor portion 22*c* so as to be spaced apart the surface of the photoreceptor drum 1*c* to form a small gap therebetween. Therefore, no pinholes are formed by the wearing of the semiconductor portion 22*c*, and no transferring of the conductive agent and the crosslinker agent to the photoreceptor drum 1*c* is carried out. The semiconductor portion 22*c* is positioned so as to be spaced apart from the surface of the photoreceptor drum 1*c* to form a small gap G therebetween. Accordingly, foreign materials such as toner are not attached to the semiconductor portion 22*c*, and hence the problem of the irregular charge caused by the foreign materials attached thereto does not arise.

In the first charger of the embodiment, the conductive supporting member 23*c* is mounted on the rear side of the blade like member. A bias voltage is applied to the semiconductor portion 22*c*, through the conductive supporting member 23*c*. A proper discharge gap G can be stably kept for a long time by adjusting the elasticity of the blade like member or avoiding the yielding of the same by the conductive supporting member 23*c*. Further, the conductive supporting member 23*c* provides an effective transfer of the bias voltage to the semiconductor portion 22*c*.

For the above reasons, the charging device can maintain a stable charge performance for a long time.

Figure 31:
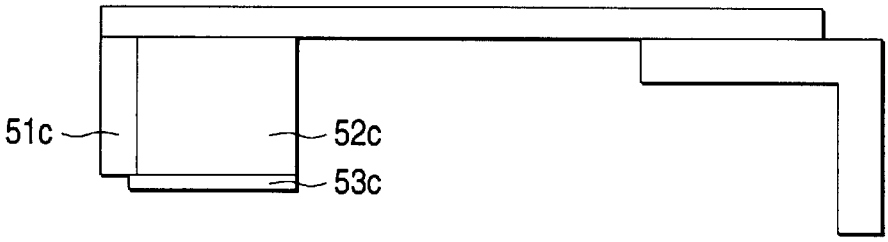
FIG. 31 is a diagram showing the construction of a charging device according to an embodiment of the present invention.
Figure 32:
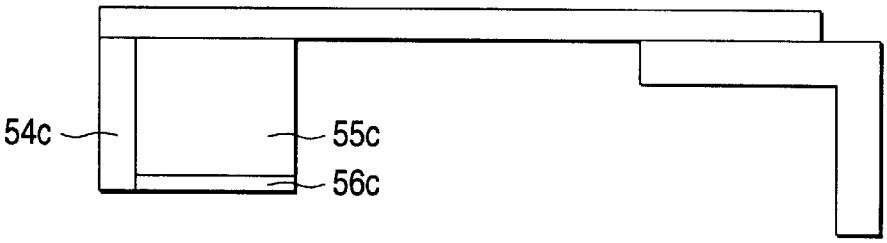
FIG. 32 is a diagram showing the construction of a charging device according to another embodiment of the present invention.

FIGS. 31 and 32 show other embodiments of the present invention. In the embodiment of FIG. 28, a protective layer 53*c* is not formed on the semiconductor portion 22. However, the pinhole leak never takes place if pinholes are present in the surface of the photoreceptor drum 1*c*, since the semiconductor portion 22*c*, applied with a bias voltage, is positioned so as to be spaced apart from the surface of the photoreceptor drum 1*c* as an image bearing means. Where the pinholes are present in the drum surface, an electric field developed between the semiconductor portion 22*c* and the photoreceptor drum 1*c* is not uniform, so that a discharge occurring therebetween is not uniform. To avoid this disadvantage, the protective layer 53*c* is formed on the surface of the semiconductor portion 22*c* in the embodiment of FIG. 31.

In the embodiment of FIG. 31, an insulating layer 51*c* is made of urethane rubber, and a semiconductor layer 52*c* is made of urethane containing $LiClO_4$ added thereto and having the volume resistivity of $10^5$ Ω·cm. Urethane containing a trace of $LiClO_4$ added thereto and having the volume resistivity of $10^8$ Ω·cm is coated, 20 μm thick, on the surface of the semiconductor layer, thereby forming a protective layer 53*c*. Other dimensions and the construction of the conductive supporting member 23*c* are substantially the same as those in the embodiment of FIG. 28.

In the embodiment of FIG. 32, an insulating layer 54*c* is made of urethane rubber, and a semiconductor layer 55*c* is made of EPDM rubber containing carbon black dispersed thereinto and having the volume resistivity of $10^5$ Ω·cm. Acrylic resin containing carbon black dispersed thereinto and having the volume resistivity of $10^8$ Ω·cm is coated, 20 μm thick, on the surface of the semiconductor layer, thereby forming a protective layer 56*c*. Other dimensions and the construction of the conductive supporting member are substantially the same as those in the embodiment of FIG. 28.

The embodiments of FIGS. 31 and 32 also have the useful effects comparable with those of the first embodiment.

Figure 33A:
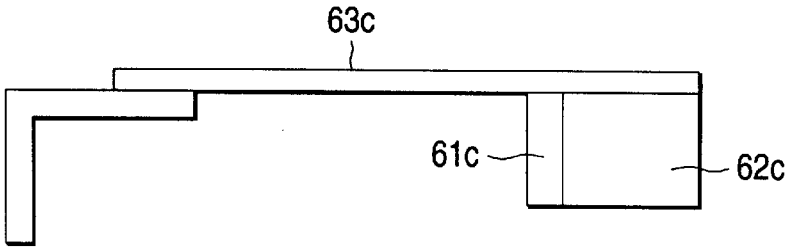
FIG. 33A shows the construction of a charging device according to yet another embodiment of the present invention.
Figure 33B:
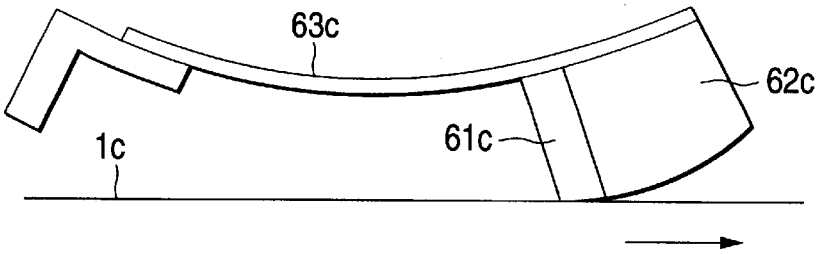
FIG. 33B shows a state of the charging device when it is used.

FIG. 33A shows a diagram of another embodiment of a charging device of the present invention. An insulating layer 61*c* and a semiconductor layer 62*c* are substantially the same as those in the embodiment of FIG. 28. In case where a blade type charging device 2*c* is disposed downstream of a cleaning blade 9ac, if a pressure of the charging device 2*c* is small, there is a chance that the charging device 2*c* is bent.

To cope with the problem, in this embodiment, the blade like member is mounted such that the blade like member is inclined from the upstream to the downstream when viewed in the moving direction of the surface of the photoreceptor drum 1*c*, while the semiconductor portion 62*c* is disposed close to the drum surface. Also in this case, what comes in contact with the surface of the photoreceptor drum 1*c* is the insulating portion 61*c* as in the embodiment already described. In this embodiment, a conductive supporting member 63*c* may be bent in advance as required. The present embodiment thus constructed reliably removes the residual toner by the cleaning blade 9*ac*, and when the residual toner reaching the charging device 2*c* is small in amount, the blade like member is not bent. Further, the insulating layer 61*c* is little worn, and a proper discharge gap can be maintained for a long time.

Figure 34A:
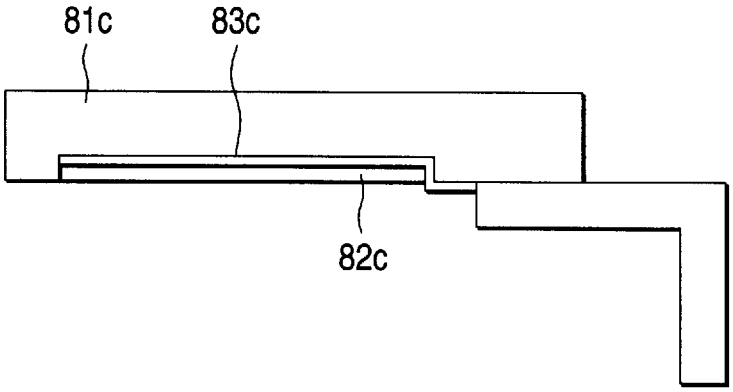
FIG. 34A shows the construction of a charging device according to still another embodiment of the present invention.
Figure 34B:
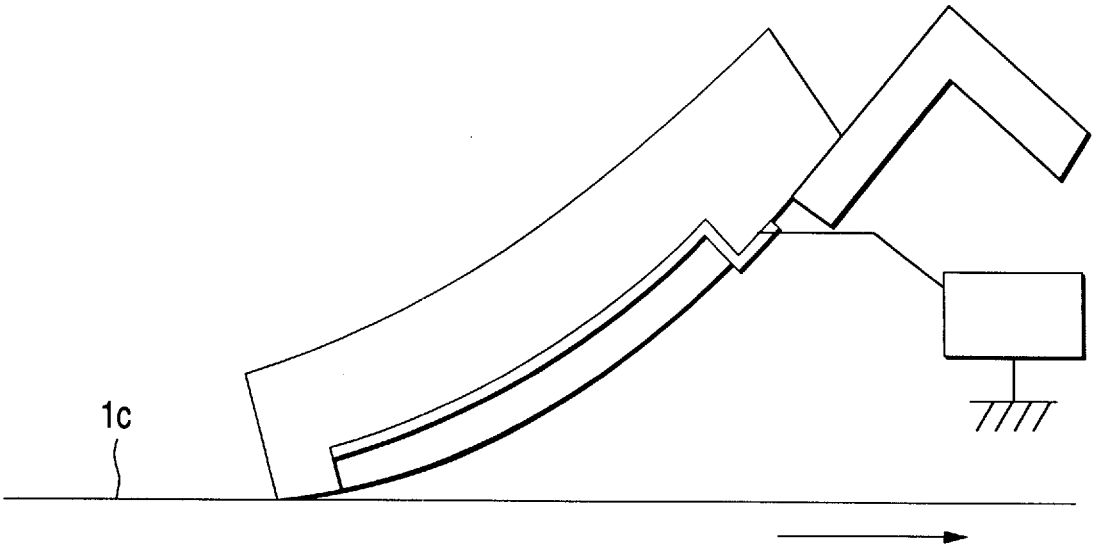
FIG. 34B shows a state of the charging device when it is used.

FIG. 34A shows a further embodiment of the present invention. While in the above-mentioned embodiment, the rubber layers 21*c* and 22*c* are mounted on the conductive supporting member 23*c*, an electrode layer 83*c* and a semiconductor layer 82*c* may be embedded in an urethane blade 81*c*. The electrode layer 83*c* may be a conductive coating containing carbon dispersed therein or a thin metal sheet having the volume resistivity of approximately $10^3$ Ω·cm or lower. With such a structure that the electrode layer 83*c* and the semiconductor layer 82*c* are embedded in an urethane blade 81*c*, the cost to manufacture is reduced. Also in the present embodiment, the electrode layer 83*c* may be supported in a state that it is spaced apart from the image bearing means 1*c*. Accordingly, the embodiment has the useful effects comparable with those of the FIG. 28 embodiment.

Figure 35A:
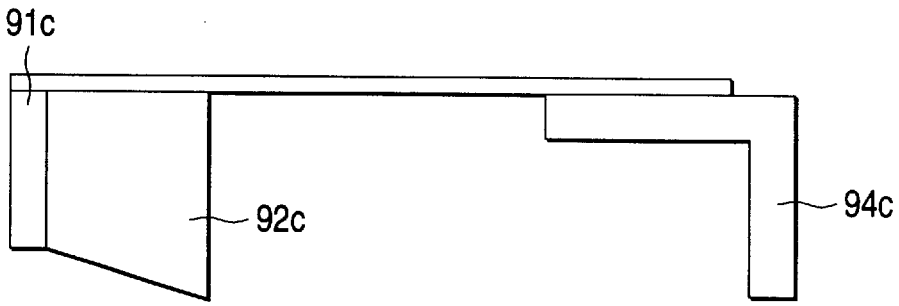
FIG. 35A shows the construction of a charging device according to a further embodiment of the present invention.
Figure 35B:
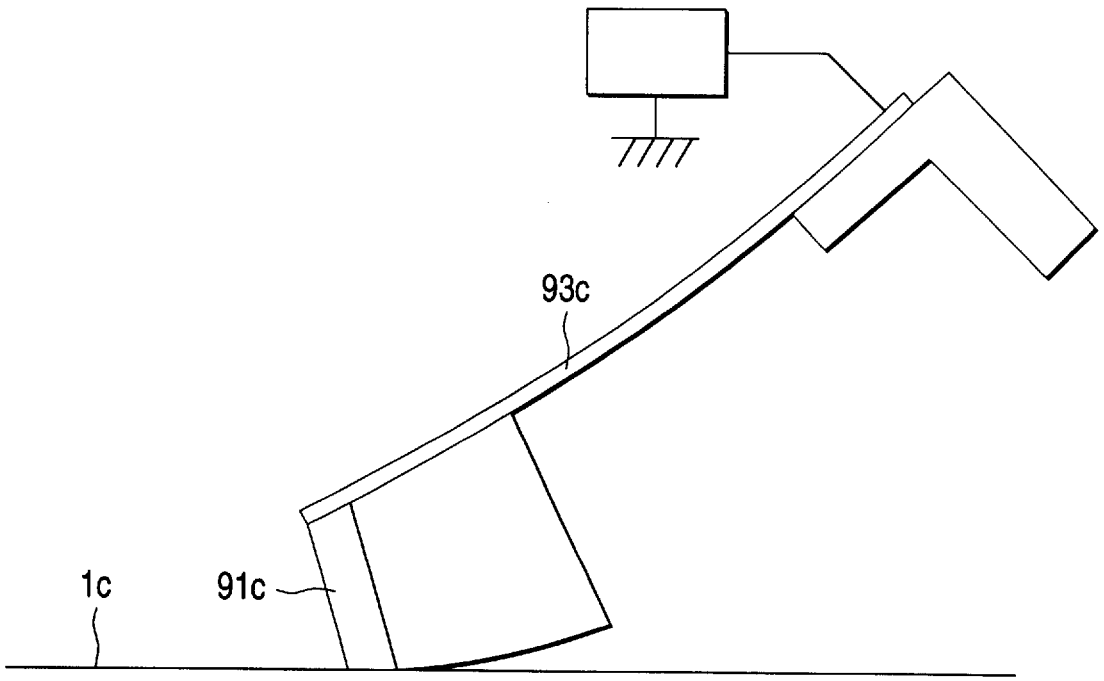
FIG. 35B shows a state of the charging device when it is used.

FIG. 35A shows an additional embodiment of the present invention. In the above-mentioned embodiment, the insulating portion 21*c* and the semiconductor portion 22*c* are coupled so that the surfaces of them are flush with each other. In the present embodiment, as shown in FIG. 35, the surface of a semiconductor portion 92*c* is tapered. With the tapered surface of the semiconductor portion 92*c*, when the blade like member is brought into contact with the surface of the photoreceptor drum 1c, the insulating portion 91*c* and the semiconductor portion 92*c* are deformed, to thereby form an accurate, small and long gap between the semiconductor portion 92*c* and the surface of the photoreceptor drum 1*c*.

Figure 36:
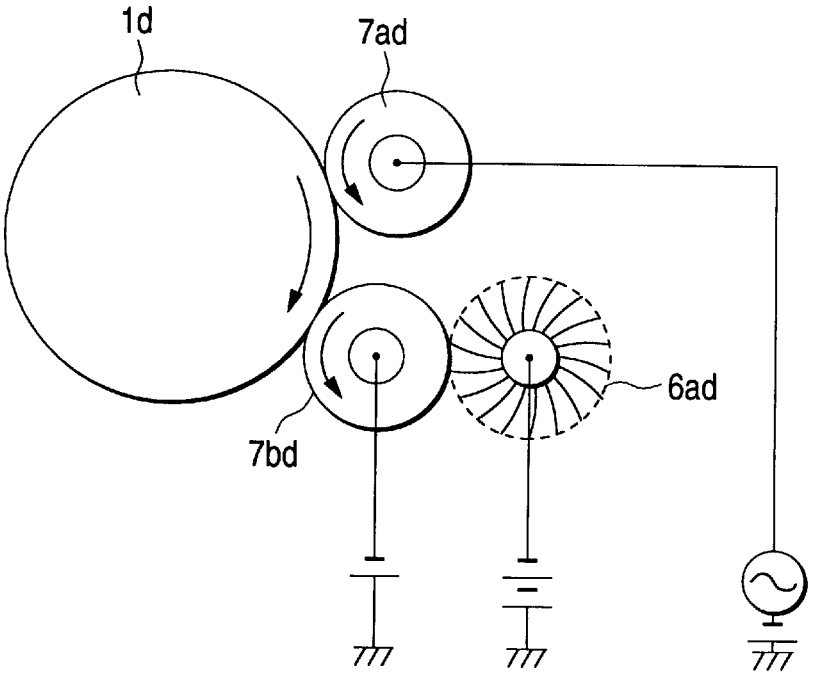
FIG. 36 is a diagram showing a first modification of the charging roll cleaning means according to the present invention.

In the present embodiment, as shown in FIG. 36, a charging device for the image forming apparatus, which has a first charger 7*ad* for primarily charging an image bearing means 1*d* when it receives a voltage consisting of a DC voltage superposed on an AC voltage, and a second contact charging roll 7*bd* for secondarily charging the image bearing means when it receives such a voltage as to vary at least a part of a pattern of charge potential variation, of which the pitch corresponds to the frequency pitch of the AC component, caused in the primary charging operation by the first charger through the discharging operation to be caused by the DC voltage per se, is improved in that a charging roll cleaning means for cleaning the second contact charging roll 7*bd* is further provided.

The charging roll cleaning means is formed of a conductive brush roll 6*ad* put on a conductive shaft.

The conductive brush is formed by braiding conductive brush fibers, 6.5 mm long and 25 $\mu$m in diameter and made of polypropylene, at 60,000 fibers/inch$^2$ in fiber density.

In the present embodiment, the conductive brush roll 6*ad* is pressed against the second contact charging roll 7*bd* so as to be thrust into the second contact charging roll up to depth of 0.4 mm. The depth is the result of subtracting a distance between the centers of the conductive brush roll 6*ad* and the second contact charging roll 7*bd* from the sum of the radii of the conductive brush roll 6*ad* and the second contact charging roll 7*bd* before those are brought into contact with each other.

In the embodiment, the conductive brush roll 6*ad* was rotated so that V1/V2=1.6 where V1 indicates a linear velocity of the circumference of the conductive brush roll 6*ad*, and V2 indicates a linear velocity of the circumference of the second contact charging roll 7*bd*. A cleaning voltage of −3000 V (C) was applied to the shaft of the conductive brush roll 6*ad* when an interimage portion confronted with the contact charging member in the successive image forming process following the turn-on of a print switch, and when the successive image forming process ended.

Black band images of 1 cm wide were successively formed at the intervals of 6 seconds for one hour. Much soil were observed on the conductive brush roll 6*ad* but no soil was observed on the surface of the second contact charging roll 7*bd*. It was confirmed that the conductive brush roll 6*ad* had a good cleaning ability.

After the experiment, the surface of the second contact charging roll 7*bd* was carefully examined. No film of soil formed on the surface of the second contact charging roll 7*bd* was observed.

The soil on the conductive brush roll 6*ad* was also examined. It was found that the soil consisted of soil electrostatically attached to the conductive brush roll 6*ad* and soil mechanically attached thereto.

When the cleaning voltage is applied to the brush roll shaft, the surface potential of the second contact charging roll 7*bd* and hence the charge potential on the photoreceptor 1*d* are increased to be higher than a desired potential. To avoid this, it is preferable to apply the cleaning voltage to the brush roll shaft when the second contact charging roll 7*bd* for charging the surface of the photoreceptor 1*d* rests.

Figure 37:
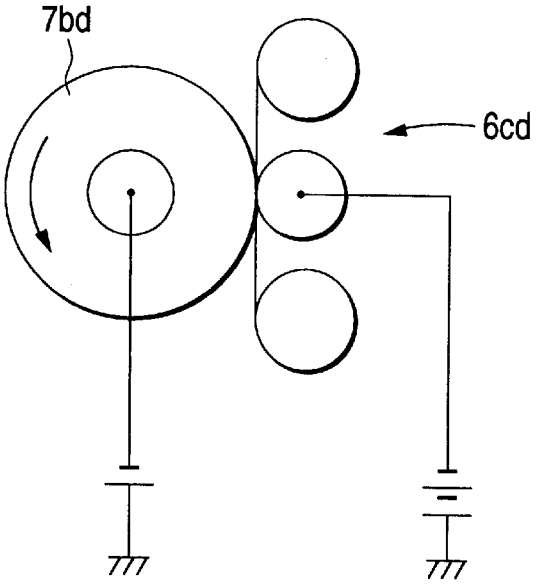
FIG. 37 is a diagram showing a second modification of the charging roll cleaning means according to the present invention.
Figure 38:
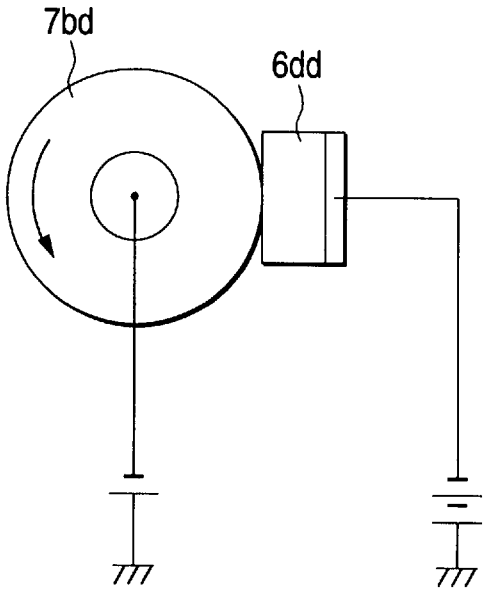
FIG. 38 is a diagram showing a third modification of the charging roll cleaning means according to the present invention.
Figure 39:
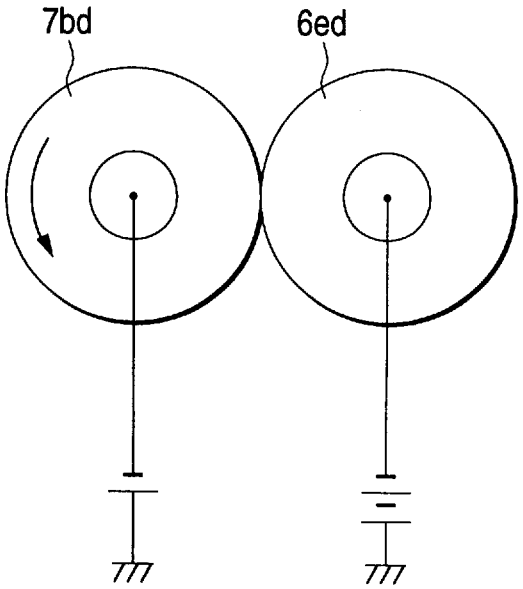
FIG. 39 is a diagram showing a fourth modification of the charging roll cleaning means according to the present invention.
Figure 40:
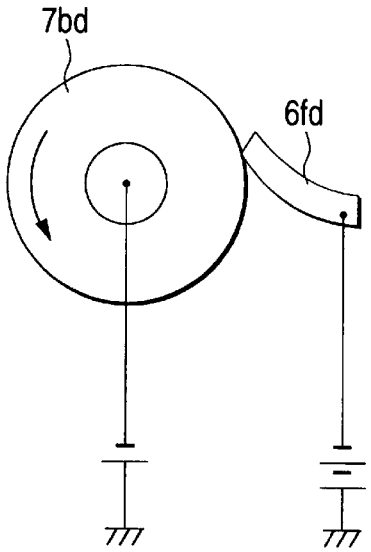
FIG. 40 is a diagram showing a fifth modification of the charging roll cleaning means according to the present invention.

In the embodiment, the charging roll cleaning means, formed of the conductive brush roll 6*ad*, is pressed against the second contact charging roll 7*bd*. As shown in FIG. 37, the charging roll cleaning means may be formed of a take-up type web 6*cd*, and conductive rolls spaced apart from each other. The charging roll cleaning means is disposed such that the web is brought into contact with the second contact charging roll 7*bd*. As shown in FIG. 38, the charging roll cleaning means may be formed of a conductive pad 6*dd*, and brought into contact with the second contact charging roll 7*bd*. As shown in FIG. 39, the charging roll cleaning means may be formed of a conductive roller 6*ed*, and brought into contact with the second contact charging roll 7*bd*. As shown in FIG. 40, the charging roll cleaning means may be formed of a conductive blade 6*fd*, and brought into contact with the second contact charging roll 7*bd*.

An experiment, similar to the above-mentioned one, was carried out in which the cleaning voltage was varied from −500 V to −4350 V.

Figure 41:
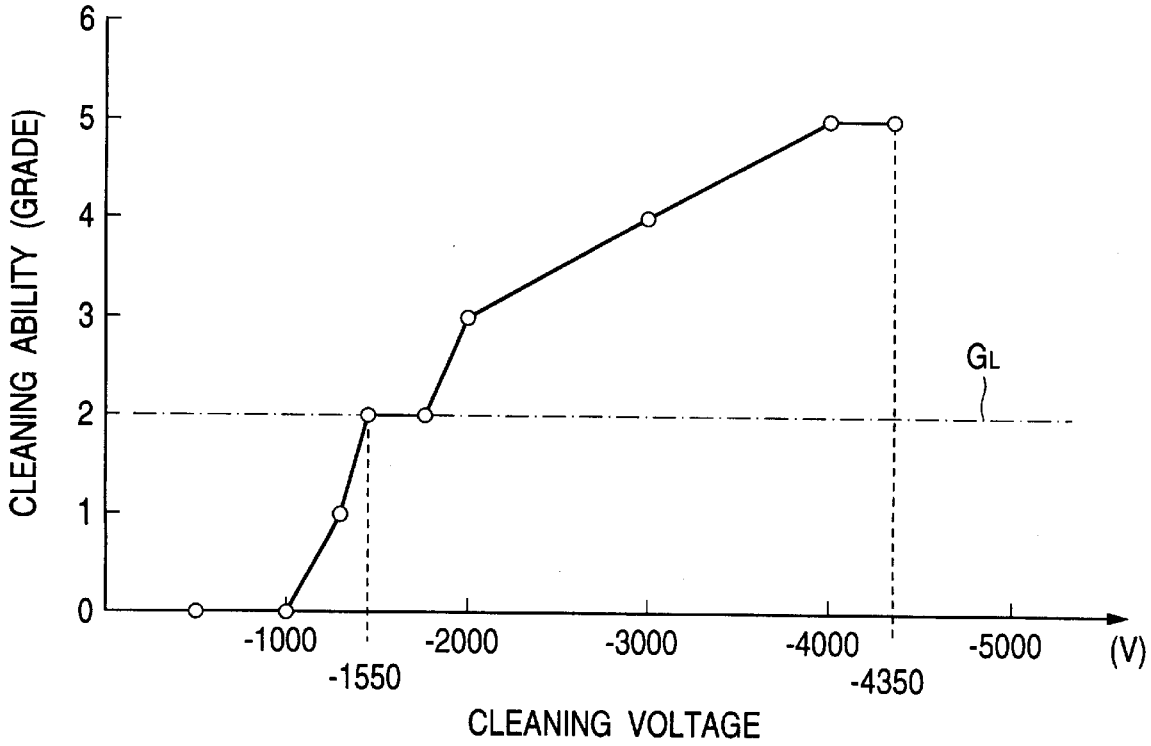
FIG. 41 is a graph showing a variation of the cleaning ability with respect to the cleaning voltage.

As seen from FIG. 41, when the cleaning voltage of −1550 V or lower, which is equal to the sum of 200 V or more and the charge voltage applied to the second contact charging roll 7*bd*, was applied to the brush roll shaft, the cleaning ability was grade 2 or higher.

When the cleaning voltage of −4350 V, which is equal to the sum of 3000 V and the charge voltage applied to the second contact charging roll 7*bd*, was applied to the brush roll shaft, a spark discharge occurred between the conductive brush roll 6*ad* and the second contact charging roll 7*bd*, so that those rolls were molten.

The above facts teach that if the difference between the cleaning voltage and the charging voltage is within the range from 200 V to 3000 V, a satisfactory cleaning ability is secured not attendant with any problem created anew.

A similar experiment was carried out in which the thrust of the conductive brush roll 6*ad* into the second contact charging roll 7*bd* was varied from 0 mm to 1.6 mm.

Figure 42:
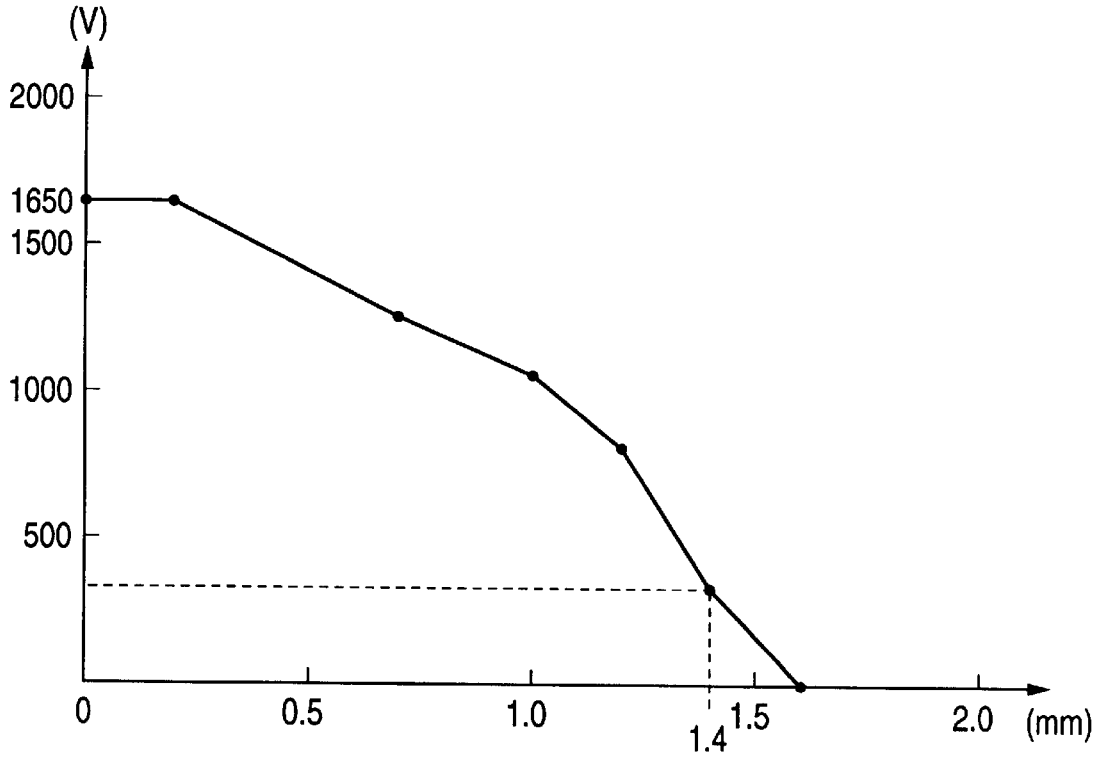
FIG. 42 is a graph showing a variation of the potential difference between the conductive brush roll and the contact charging roll with respect to the thrust of the conductive brush roll into the second contact charging roll.

The results of the experiment are shown in FIG. 42. As shown, in order that the potential difference between the conductive brush roll 6*ad* and the second contact charging roll 7*bd* is 200 V or larger, the thrust must be 1.4 mm or shorter. If the thrust is larger than 1.4 mm, an electric field formed between the conductive brush roll 6*ad* and the second contact charging roll 7*bd* is improper, and the cleaning ability is lower than grade 2. Consequently, it is seen that a satisfactory cleaning ability is secured when the thrust of the conductive brush roll 6*ad* into the second contact charging roll 7*bd* is 1.4 mm or shorter.

A similar experiment was carried out in which the thrust of the conductive brush roll 6*ad* into the second contact charging roll 7*bd* was varied from 0 mm to 1.4 mm.

The results of the experiment are shown in Table 1. As shown, when the thrust is within the range from 0.1 mm to 1.2 mm, the cleaning ability was satisfactory, and no filming was formed.

In other words, no filming occurs and a satisfactory cleaning ability is secured if the thrust is within the range from 0.1 mm to 1.2 mm.

TABLE 1

| Thrust (mm) | Cleaning ability (Grade) | Occurrence of filming |
|---|---|---|
| 0.0 | 0 | ○ |
| 0.1 | 2 | ○ |
| 0.2 | 4 | ○ |
| 0.4 | 4 | ○ |
| 0.7 | 4 | ○ |
| 1.0 | 4 | ○ |
| 1.2 | 4 | Δ |
| 1.4 | 4 | X |

(○: no filming occurred,
Δ: filming locally occurred,
X: filming entirely occurred)

A similar experiment was carried out in which a velocity ratio of V1/V2 was varied from 0.8 to 2.0. In the ratio, V1 indicates a linear velocity of the circumference of the conductive brush roll 6*ad*, and V2 indicates a linear velocity of the circumference of the second contact charging roll 7*bd*.

The results of the experiment are shown in Table 2. As shown, the filming occurred when V1/V2=0.8.

When the velocity ratio V1/V2 was between 1.0 and 2.0, no filming occurred and a satisfactory cleaning ability was secured.

TABLE 2

| Velocity ratio (V1/V2) | Cleaning ability (Grade) | Occurrence of filming |
|---|---|---|
| 0.8 | 3 | X |
| 1.0 | 2 | ○ |
| 1.3 | 3 | ○ |
| 1.6 | 4 | ○ |
| 2.0 | 4 | Δ |

(○: no filming occurred,
Δ: filming locally occurred,
X: filming entirely occurred)

A similar experiment was carried out in which the fiber density of the conductive brush roll 6*ad* was varied from 10,000 fibers/inch$^2$ to 130,000 fibers/inch$^2$.

The results of the experiment are shown in Table 3. As shown, for the entire range of the fiber densities, no filming occurred and a satisfactory cleaning ability was secured.

In other words, no filming occurs and a satisfactory cleaning ability is secured if the fiber density of the conductive brush roll 6*ad* is within the range from 10,000 fibers/inch$^2$ to 130,000 fibers/inch$^2$.

TABLE 3

| Fiber density (Fibers/inch$^2$) | Cleaning ability (Grade) | Occurrence of filming |
|---|---|---|
| 10,000 | 1 | ○ |
| 30,000 | 4 | ○ |
| 60,000 | 4 | ○ |
| 100,000 | 4 | ○ |
| 130,000 | 4 | ○ |

(○: no filming occurred,
Δ: filming locally occurred,
X: filming entirely occurred)

A similar experiment was carried out in which the length of each brush fiber was varied from 0.8 mm to 2.0 mm.

The results of the experiment are shown in Table 4. As shown, the filming occurred when the fiber length was 20 mm.

When the fiber length of the conductive brush roll 6*ad* is within the range of 2.0 mm to 15 mm, no filming occurs and a satisfactory cleaning ability is secured.

TABLE 4

| Fiber length (mm) | Cleaning ability (Grade) | Occurrence of filming |
|---|---|---|
| 2.0 | 5 | ○ |
| 4.5 | 4 | ○ |
| 6.5 | 4 | ○ |
| 10 | 3 | ○ |
| 15 | 2 | Δ |
| 20 | 2 | X |

(○: no filming occurred,

TABLE 4-continued

| Fiber length (mm) | Cleaning ability (Grade) | Occurrence of filming |
|---|---|---|

Δ: filming locally occurred,
X: filming entirely occurred)

A similar experiment was carried out in which the diameter of each fiber length of the conductive brush roll 6*ad* was varied from 10 $\mu$m to 60 $\mu$m.

The results of the experiment are shown in Table 4. As shown, for the entire range of the fiber diameters, no filming occurred and a satisfactory cleaning ability was secured.

In other words, no filming occurs and a satisfactory cleaning ability is secured if the fiber diameter of the conductive brush roll 6*ad* is within the range from 10 $\mu$m to 60 $\mu$m.

TABLE 5

| Fiber diameter ($\mu$m) | Cleaning ability (Grade) | Occurrence of filming |
|---|---|---|
| 10 | 5 | ○ |
| 25 | 4 | ○ |
| 35 | 4 | ○ |
| 60 | 4 | ○ |

(○: no filming occurred,
Δ: filming locally occurred,
X: filming entirely occurred)

An image forming apparatus of the present embodiment is substantially the same as of the above-mentioned embodiment except that a soil collecting means for collecting soil from the conductive brush roll 6*ad* is provided.

Figure 43:
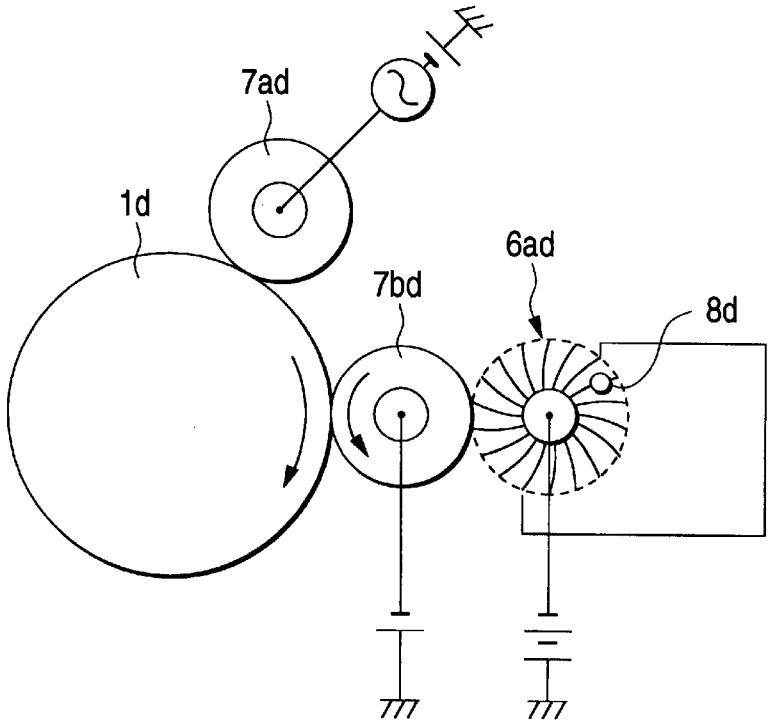
FIG. 43 is a front view showing a key portion of an image forming apparatus according to another embodiment of the present invention.

The soil collecting means, as shown in FIG. 43, is a flicker bar 8*d* located in the brush fibers of the conductive brush roll 6*ad*.

Black band images of 1 cm wide were successively formed at the intervals of 6 seconds for one hour. No soil was observed on both the conductive brush roll 6*ad* and the surface of the second contact charging roll 7*bd*. From this, it was confirmed that with provision of the flicker bar 8*d*, the cleaning ability of the conductive brush roll 6*ad* was not lost.

What is claimed is:

1. A charging method in which the surface of an image bearing device is charged in two-steps before a latent image is formed on the surface of the image bearing device, comprising the steps of:

primarily charging the surface of said image bearing device by a contact charging device applied with a voltage that includes an AC component and a DC component superimposed on the AC component; and secondarily charging the surface of the image bearing device by a contact charging device applied with such a DC voltage as to discharge at least part of a pattern of charge potential variation of which a pitch corresponds to a frequency pitch of the AC component, caused in the primarily charging operation, wherein the step of primarily charging and the step of secondarily charging are performed by using two contact chargers, and wherein the DC voltage applied to the contact charging device for secondarily charging the surface of the image bearing device is preferably such a DC voltage as to entirely discharge a pattern of charge potential variation of which the pitch corresponds to the frequency pitch of the AC component, caused in the step of primarily charging.

2. The charging method of claim 1, wherein the DC voltage applied to the contact charging device for secondarily charging the surface of the image bearing device is controlled such that a current flowing into the contact charging device is detected to be constant.

3. A charging device in which a surface of an image bearing device is charged in two steps before a latent image is formed on the image bearing device, comprising:

a first contact charger for primarily charging the surface of the image bearing device in a state that the first contact charger receives a voltage that includes an AC component and a DC component superposed on the AC component; and a second contact charger for secondarily charging the surface of the image bearing device in a state that the second contact charger receives such a DC voltage as to discharge at least part of a pattern of charge potential variation of which a pitch corresponds to a frequency pitch of the AC component, caused in the primarily charging operation, wherein the DC voltage is applied to the second contact charger so as to entirely discharge a pattern of charge potential variation of which the pitch corresponds to the frequency pitch of the AC component, caused in the primary charging operation.

4. The charging device of claim 3, wherein the second contact charger receives a DC voltage controlled such that a current flowing into a charger is detected to be constant.

5. The charging device of claim 3, wherein the second contact charger includes:

a current detecting means for detecting a current flowing into said second contact charger, and a voltage control means for controlling the DC voltage applied thereto so that the current is constant.

6. The charging device of claim 3, wherein said first contact charger is a contact charger selected from a group of the blade, brush and film type, and said second contact charger is a contact charger of the roll type.

7. The charging device of claim 3, wherein said first contact charger is a charging blade, and said second contact charger is a charging roll, wherein said charging blade is brought into contact with said image bearing device in a state that said charging blade is slanted in a counter direction.

8. The charging device of claim 3, wherein said first contact charger is a charging blade, and said second contact charger is a charging roll, wherein an angle which said image bearing device and a downstream side gap make is acuter than that which said image bearing device and an upstream side gap make at a position where said charging blade is brought into contact with said image bearing device.

9. The charging device of claim 3, wherein:

said first contact charger is a charging blade, said second contact charger is a charging roll, a charging area is made at a downstream side gap when viewed in a moving direction of said image bearing device at a position where said charging blade is brought into contact with said image bearing device, and a downstream gap is wider along the downstream direction when viewed in the moving direction of said image bearing device.

10. The charging device of claim 9, wherein said charging blade includes a conductive supporting member mounted on a rear side thereof, and a bias voltage is applied to a semiconductor portion through said conductive supporting member.

11. The charging device of claim 3, wherein said first contact charger is a charging blade, comprising:

a semiconductor section applied with a bias voltage, and an insulating section of which a part is contact with said image bearing device, the surface of said charging blade which is opposite to said image bearing device is located at a position which is separate from said image bearing device.

12. The charging device of claim 3, wherein said first contact charger is a charging blade including;

a semiconductor portion for discharging to said image bearing device upon receiving a bias voltage, and an insulating portion brought into contact with said image bearing device to locate said semiconductor portion so as to be spaced apart from the surface of said image bearing device to form a small gap therebetween.

13. An image forming apparatus comprising:

an image bearing device, first and second chargers, sequentially arranged for charging the image bearing device in a state that said first and said second chargers are in contact with said image bearing device, first voltage applying means for applying a voltage that includes an AC component and a DC component superposed on the AC component to said first charger, and second voltage applying means for applying to said second charger such a DC voltage as to discharge at least part of a pattern of charge potential variation of which a pitch corresponds to a frequency pitch of the AC component, wherein said second voltage applying means applies a DC voltage as to entirely discharge a pattern of charge potential variation of which the pitch corresponds to the frequency pitch of the AC component.

14. The image forming apparatus of claim 13, wherein said first contact charger is a contact charger selected from a group of the blade, brush and film type, and said second contact charger is a contact charger of the roll type.

15. The image forming apparatus of claim 13, wherein a cleaning means is disposed adjacent to said second charger, and a voltage, which is opposite in polarity and equal in absolute value to the DC voltage applied to said second charger, is applied to said cleaning means.

16. The image forming apparatus of claim 15, wherein the difference between the voltage applied to said cleaning means and the DC voltage applied to said second charger is within a range from 200 V to 3000 V, in absolute value.

17. The image forming apparatus of claim 15, wherein said cleaning means and said second charger are rotatable, and a velocity ratio V1/V2 is within a range from 1 to 2, wherein V1 indicates a linear velocity of the surface of said cleaning means at a position where said cleaning means is brought into contact with said second charger, and V2 indicates a linear velocity of the surface of said second charger at the contact position.

18. The image forming apparatus of claim 17, further comprising:

a collecting means for collecting soil from a conductive brush.

19. The image forming apparatus of claim 15, further comprising:

a collecting means for collecting soil from a conductive brush.

20. An image forming apparatus comprising:

an image bearing device, a first contact charger which brings to contact with and charges onto a surface of said image bearing device, a second contact charger provided on a downstream side of said image bearing device with respect to said first contact charger, a first voltage applying means for applying said first contact charger with a voltage that includes an AC component and a DC component superposed on the AC component, a second voltage applying means for applying said second contact charger with a DC component, wherein the DC component applied to said second contact charger is determined, so that an absolute value of the peak voltage of the charging pattern by said first contact charger is larger than a discharging voltage by said second contact charger, when the charging of said image bearing device is deteriorated.

* * * * *